US006374490B1

(12) United States Patent
Miyahara

(10) Patent No.: US 6,374,490 B1
(45) Date of Patent: Apr. 23, 2002

(54) METHOD OF FORMING A HOLLOW POLE PROJECTING ON A PLATE AND A METHOD OF MANUFACTURING A HEAT SINK USING SAID METHOD

(75) Inventor: Hideyuki Miyahara, Okaya (JP)

(73) Assignee: Nakamura Seisakusho Kabushikigaisha, Okaya (JP)

( * ) Notice: Subject to any disclaimer, the term of this patent is extended or adjusted under 35 U.S.C. 154(b) by 0 days.

(21) Appl. No.: 09/372,385

(22) Filed: Aug. 11, 1999

(30) Foreign Application Priority Data

Aug. 12, 1998 (JP) ..... 10-241057
Aug. 28, 1998 (JP) ..... 10-259251

(51) Int. Cl.[7] ..... B12D 53/02
(52) U.S. Cl. ..... 29/890.03; 29/557; 72/334
(58) Field of Search ..... 29/890.03, 557, 29/558, 890.053; 72/334, 332, 333, 356; 165/80.3, 80.2, 80.4, 185

(56) References Cited

U.S. PATENT DOCUMENTS 1,173,793 A * 2/1916 George ..... 72/370.03
1,699,361 A * 1/1929 Karmazin ..... 72/334
2,308,953 A * 1/1943 Brown ..... 72/327
2,743,518 A * 5/1956 Zohodiakin ..... 72/332
2,898,788 A * 8/1959 Baxa ..... 72/355.4
2,909,281 A * 10/1959 Koskinen ..... 72/377
2,977,918 A * 4/1961 Kritzer ..... 29/890.047
3,080,839 A * 3/1963 Fein et al. ..... 72/326
3,131,758 A * 5/1964 Kern et al. ..... 165/158
3,245,465 A * 4/1966 Young ..... 165/148
3,682,122 A * 8/1972 Haddon et al. ..... 72/334
3,757,718 A * 9/1973 Johnson ..... 72/57
4,109,501 A * 8/1978 Kozima ..... 72/356
4,150,556 A * 4/1979 Melnyk ..... 72/333
4,400,965 A * 8/1983 Schey ..... 72/334
5,237,849 A * 8/1993 Miyazawa ..... 72/333
5,448,832 A * 9/1995 Kanemitsu et al. ..... 72/333
5,600,992 A * 2/1997 Kanazawa et al. ..... 72/356
5,761,949 A * 6/1998 Dalessandro et al. ..... 72/334
5,797,291 A * 8/1998 Yamada ..... 72/334
6,134,783 A * 10/2000 Bargman et al. ..... 29/890.03

FOREIGN PATENT DOCUMENTS

JP 6-26737 4/1994

* cited by examiner

*Primary Examiner*—I Cuda Rosenbaum
*Assistant Examiner*—T. Nguyen
(74) *Attorney, Agent, or Firm*—Flynn, Thiel, Boutell & Tanis, P.C.

(57) ABSTRACT

A method of forming a hollow pole projecting from a metal plate by plastic deformation and comprising the steps of: (a) pressing the plate from one surface of the plate using a press tool so as to form a hole on the one surface and a projection on the other surface thereof; (b) moving metal of the plate around said projection towards interior of said hole so as to gather the metal into a periphery of an opening of said hole using a tapered tool; (c) pressing said periphery of said hole using a flat press tool which is greater than said projection in an external diameter so as to move the metal gathered by said tapered tool further towards the interior of said hole and to increase a height of said projection; and (d) inserting said press tool into said hole while pressing the interior of said hole so as to increase further the height of said projection and to form the hollow pole. The projection can therefore be made substantially higher with respect to the thickness of the plate or the thickness of the hollow pole can be made thicker. Further, a heatsink utilizing the hollow poles as superior heat dissipating fins can be manufactured easily and cheaply.

17 Claims, 14 Drawing Sheets

METHOD OF FORMING A HOLLOW POLE PROJECTING ON A PLATE AND A METHOD OF MANUFACTURING A HEAT SINK USING SAID METHOD

FIELD OF THE INVENTION

The present invention relates to a method of forming a hollow pole projecting on a plate such as a metal plate to which various components are to be attached or which is to support a rotating member, and a method of forming heat dissipating fins by utilizing the aforementioned hollow poles in order to dissipate heat away from electronic components generating said heat in an effective manner by providing the heat dissipating fins in the vicinity of the electronic components.

DESCRIPTION OF THE PRIOR ART

In order to axially support a rotating part or axially affix other parts to a plate such as a metal plate, a hole is bored in the plate and a specially manufactured axial member is then passed through the hole. The axial member is then fixed using end fixing means or using a screw.

However, the number of components required when an axial member is separately made and fixed to a plate is large, as is the number of manufacturing steps, and high costs are therefore inevitable. Because of this, in Japanese Patent Laid-open Publication No. Hei. 6-26737, the present applicant proposed a method of integrally forming a cylindrical projection by utilizing plastic processing technology, which was extremely useful in practical terms.

FIG. 9 and FIG. 10 are views showing a method of forming a cylindrical projection at a plate proposed in the related art, where FIG. 9 is a view showing a method of forming a cylindrical projection having a bottom in the plate. First, in a first press step #10, a press tool 401 that is a circular column formed with a flat end surface is pushed against one surface of a plate 400 comprising a metal plate of a metal having plasticity such as iron or aluminum so as to form a hole 102 at the one side and a projection 403 at the other side.

Next, in a flat press step #11, the end surface of a columnar flat press tool 404 of an external diameter greater than the external diameter of the projection 403 is brought into contact with the side of the opening of the hole 402 and pressed. As a result, the metal of the pressed portion moves towards a central section 405 of the hole 402 that provides no resistance and is also moved to the projection 403 so that the projection 403 is made to project further.

In a second press step #12, the plate 400 that has undergone the flat press step #11 is again pressed by the press tool 401 from the side of the opening and the height of the projection is further increased so as to form a cylindrical projection 406 at the plate 400. The height of the cylindrical projection 406 is then two times a thickness t1 of the plate 400 or more.

FIG. 10 is a view showing a method of forming a cylindrical projection that penetrates the plate from one side to the other. Namely, up to the flat press step #11, the steps shown in FIG. 9 are gone through. Thereafter, a boring step is provided. Here, a boring tool 407 having a stem portion of a small diameter is inserted through the hole 402 and punching is carried out so as to bore a thruhole 408. Next, in a burring step #14, a burring tool 409 with a tapered front end and an external diameter that is the same as the diameter of the press tool 401 is inserted from the hole 402 and passed through while broadening out the thruhole 408 so as to form a cylindrical projection 410 having a height L02. In the method shown in FIG. 10 a height L02 of the cylindrical projection 410 is also formed to be at least twice the thickness t1 of the plate 400.

In the methods of forming a cylindrical projection at a plate described above, the cylindrical projection 406 are integrally formed at the sheet 400. Costs are therefore reduced and cylindrical projection having a height of twice the thickness of the plate 400 or more can be formed at the plate 400. There is a limit on making the cylindrical projection substantially larger with respect to the thickness t1 of the plate 400 in that the direction of the movement of the metal due to pressing by the flat press tool 404 is dispersed. There are also cases where a thick projection is required but there are limits when the thickness is increased in the related axial part forming method for the reasons state above.

As the present invention sets out to resolve the aforementioned problems of the related forming methods, it is the object of the present invention to provide a method of forming a cylindrical projection, which is substantially a hollow pole, in a plate where the hollow pole can be made substantially higher with respect to the thickness of the plate or where the thickness of the hollow pole is made thicker.

It is also a further object of the present invention to provide a method of easily and cheaply manufacturing a heatsink with superior heat dissipating effects by forming one or more heat dissipating fins utilizing the aforementioned hollow pole, and to provide a heatsink thereof.

SUMMARY OF THE INVENTION

In order to achieve the aforementioned object, according to the present invention, there is provided a method of forming a hollow pole projecting from a metal plate by plastic deformation and comprising the steps of: (a) pressing the plate from one surface of the plate using a press tool so as to form a hole on the one surface and a projection on the other surface thereof; (b) moving metal of the plate around said projection towards interior of said hole so as to gather the metal into a periphery of an opening of said hole using a tapered tool; (c) pressing said periphery of said hole using a flat press tool which is greater than said projection in an external diameter so as to move the metal gathered by said tapered tool further towards the interior of said hole and to increase a height of said projection; and (d) inserting said press tool into said hole while pressing the interior of said hole so as to increase further the height of said projection and to form the hollow pole. The projection can therefore be made substantially higher with respect to the thickness of the plate or the thickness of the hollow pole can be made thicker. Further, a heatsink utilizing the hollow poles as superior heat dissipating fins can be manufactured easily and cheaply.

BRIEF DESCRIPTION OF THE DRAWINGS

FIG. 28(A) is a perspective view of the heat dissipating fins and FIG. 28(B) is a cross-section of a die showing the slit forming method;

FIG. 29(A) is a perspective view of the heat dissipating fins and FIG. 29(B) is a cross-section of a die showing the slit forming method;

FIG. 30(A) is a perspective view of the heat dissipating fins and FIG. 30(B) is a cross-section of a die showing the slit forming method.

DETAILED DESCRIPTION OF THE PREFERRED EMBODIMENTS

The following is a detailed description with reference to the drawings of a method of forming a hollow pole in a plate of the present invention.

Figure 1:
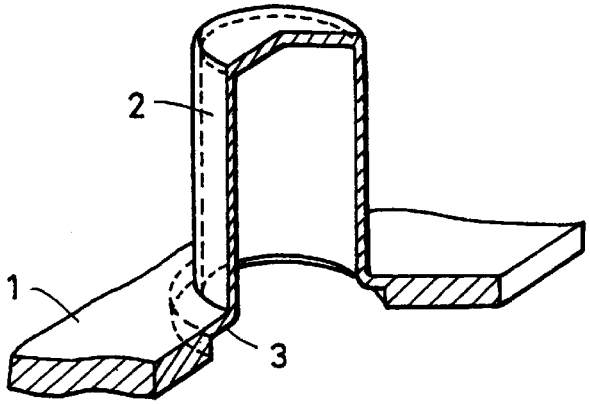
FIG. 1 is a sectional oblique cross-section showing an example of a plate formed with a hollow pole of the present invention.

FIG. 1 is a sectional oblique cross-section showing a hollow pole manufactured using the method of the present invention. Here, a metal plate such as iron, copper, aluminum, or brass to which plastic deformation is applied is selected as a plate 1. A hollow pole 2 is then formed as a single hollow circular cylindrical body with a bottom protruding from the inside of the plate by plastically deforming a part of the plate 1. This hollow pole 2 is formed to a height that is three to five times the thickness of the plate 1 by forming method described in detail later.

A recess 3 having a prescribed internal diameter is formed at the peripheral edge of an opening at the lower side of the recess 3. This recess 3 is thinner than the plate 1, with the metal originally at this portion having been moved to the hollow pole 2 during plastic deformation in order to obtain the prescribed height for the hollow pole 2. It is also possible for a plurality of hollow poles to be provided next to each other at intervals of greater than the prescribed internal diameter of the recess 3. Further, it is preferably for the recess 3 to be circular when the hollow pole 2 is circular but a polygon shape such as a substantially quadrangular shape or triangular shape or an ellipsoidal shape is also possible.

Figure 2:
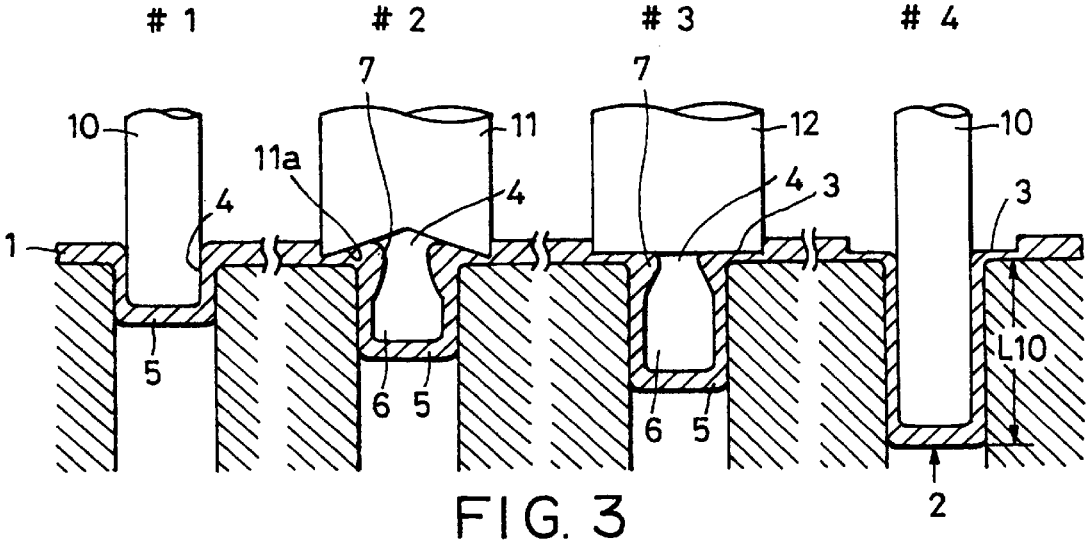
FIG. 2 is a process view showing steps of a method for forming a hollow pole at a plate of the present invention.

Next, a description is given of the method of the present invention for forming a hollow pole in a plate. FIG. 2 is a view showing the processes for forming the hollow pole 2 formed as a hollow circular cylinder with a bottom from the interior of a plate. First, in a first press step #1, one side of the plate 1 being a metal plate of iron or copper etc. is pressed by a press tool 10, with a hole 4 being formed on the one side of the plate 1 and a projection 5 being formed on the other side of the plate. The press tool 10 is formed as a cylindrical column with a flat end surface and the projection 5 is formed in substantially a cylindrical shape due to pressing by the press tool 10.

Next, in a metal shifting step #2, which is a principal process of the present invention, metal at the periphery of the opening for the hole 4 is gathered so as to be moved in a direction towards the inside of the hole 4.

A tapered tool 11 used in step #2 is formed as a cylindrical column of an external diameter greater than the external diameter of the projection 5. The end surface of the tapered tool 11 is formed with a tapered recess 11*a* having a tapered surface recessed in a substantially conical shape from the outer periphery of the end surface towards the center of the end surface. This tapered tool 11 is pressed down so as to come into contact from the side of the hole 4 of the plate 1. As a result, metal at the periphery of the opening of the hole 4 is gathered by the tapered recess 11*a* in the direction of a central part 6 in which no resistance is presented, and metal 7 moved to the side of the opening of the central part 6 is formed so that the projection 5 projects further.

The plate 1 that has passed through the metal shifting step #2 is then moved to a flat press step #3. In the flat press step #3, an end surface of a flat press tool 12 in the shape of a cylindrical column with a flat end is pressed down so as to come into contact with the side of the hole 4 of the plate 1 in such a manner as to add to the pressing processing of the tapered tool 11. The metal 7 formed on the side of the opening of the central part 6 is therefore moved in a direction towards the center of the central part 6, the metal 7 is moved in the direction of the projection 5 and the central part 6 is made to project further. The recess 3 is then formed at the periphery of the hole 4 by the pressing of the flat press tool 12.

Next, in a second press step #4, the plate 1 that has passed through the flat press step #3 is again pressed down from the side of the opening by the press tool 10 so as to add height to the projection 5 and therefore form the hollow pole 2 that is cylindrical with a bottom shown in FIG. 1.

A height L10 of this hollow pole 2 can therefore be made substantially greater than the height of the forming method of the related art because the amount of metal at the periphery of the opening of the hole 4 gathered in the direction of the central part 6 and moved to the projection 5 by the tapered recess 11*a* of the tapered tool 11 is increased.

Figure 3:
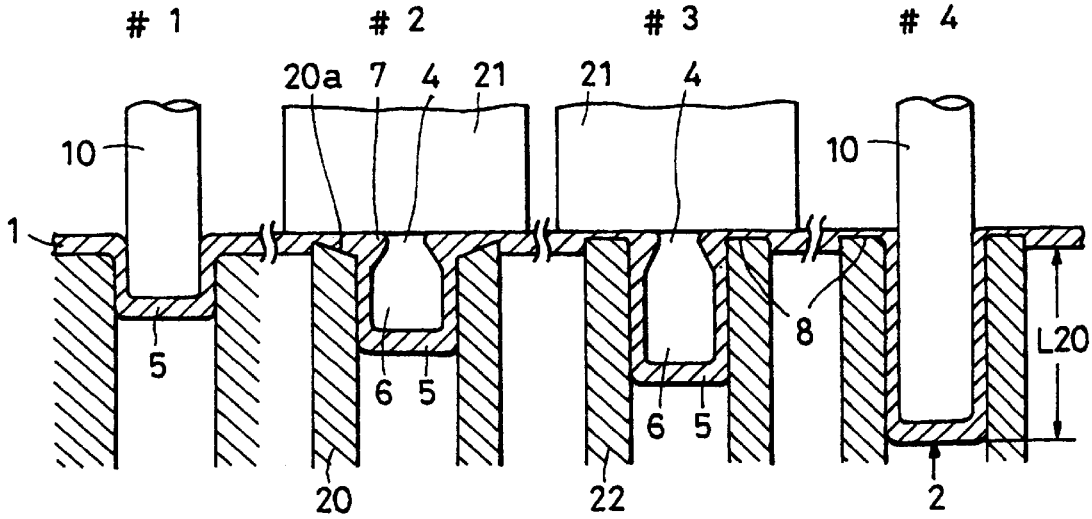
FIG. 3 is a process view showing steps of a further method for forming a hollow pole at a plate of the present invention.

FIG. 3 is a view showing a further embodiment of the method of forming a hollow pole in a plate of the present invention, i.e. in the method shown in FIG. 3, pressing is carried out from the other surface of the plate 1.

The first press step #1 of FIG. 3 is the same as the first press step #1 of FIG. 2 described previously and a description is therefore omitted. The following metal shifting step #2 is then a process for gathering metal at the periphery of the opening of the hole 4 and moving the metal in a direction towards the interior of the hole 4. A cylindrical tapered tool 20 used in this second step #2 is formed in a cylindrical shape, has an internal diameter that allows insertion of the projection 5, and a tapered part 20*a* of a substantially conical shape that is concave from the outer periphery towards the center is formed at an end surface of the cylindrical tapered tool 20.

The cylindrical tapered tool 20 is inserted into the projection 5 formed by the first press step #1, and is pressed against the edge of the hole 4 from the other side with a contact member 21 that is flat at one end pressed against one side of the plate 1. As a result, metal at the peripheral edge of the hole 4 is gathered by the tapered recess 20*a* in the direction of a central part 6 in which no resistance is presented, and metal 7 moved to the side of the opening of the central part 6 is formed so that the projection 5 projects further.

Next, in the flat press step #3, the periphery of the other side of the hole 4 is pushed down by a cylindrical flat press tool 22 that has a flat surface at one end and is of an internal diameter that permits the insertion of the projection 5, with the contact member 21 pressing down. The metal of the pressed portion is therefore moved in the direction of the central part 6 of the hole 4 and the projection 5 is made to project further. At this time, an annular recess is formed at the side of the other surface of the periphery of the projection.

After this, in the second press step #4, height is added to the projection 5 so as to give a hollow pole 2 that is cylindrical with a bottom by again pressing down with the press tool 10 from the side of the opening with the projection 5 inserted in the cylindrical flat press tool 22.

A height L20 of the hollow pole 2 formed by the forming method shown in FIG. 3 can also be made substantially greater than in related forming methods as with the method shown in FIG. 2 because metal at the periphery of the opening of the hole 4 is gathered by the tapered part 20*a* of the cylindrical tapered tool 20 and the metal moved to the projection 5 is increased.

Figure 4:
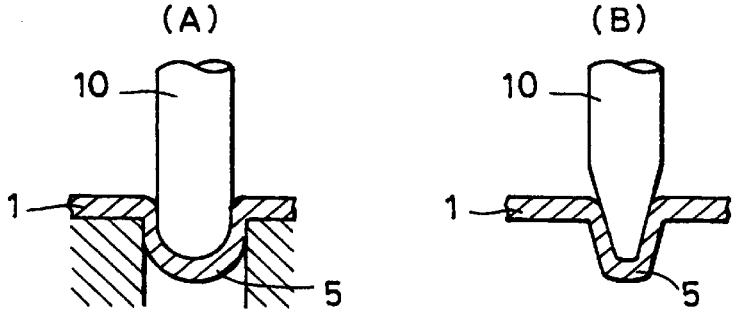
FIG. 4 is a cross-section showing a modified example of a first press step of the present invention.

FIG. 4 shows a modified example of the press tool 10 used in the first press step #1, with FIG. 4(A) showing an example where the end is formed so as to be hemispherical and FIG. 4(B) showing an example where the end is at first flat and then tapered. In each of the aforementioned methods, a hollow pole 2 higher than that of the related art can also be formed using one of these press tools.

Figure 5:
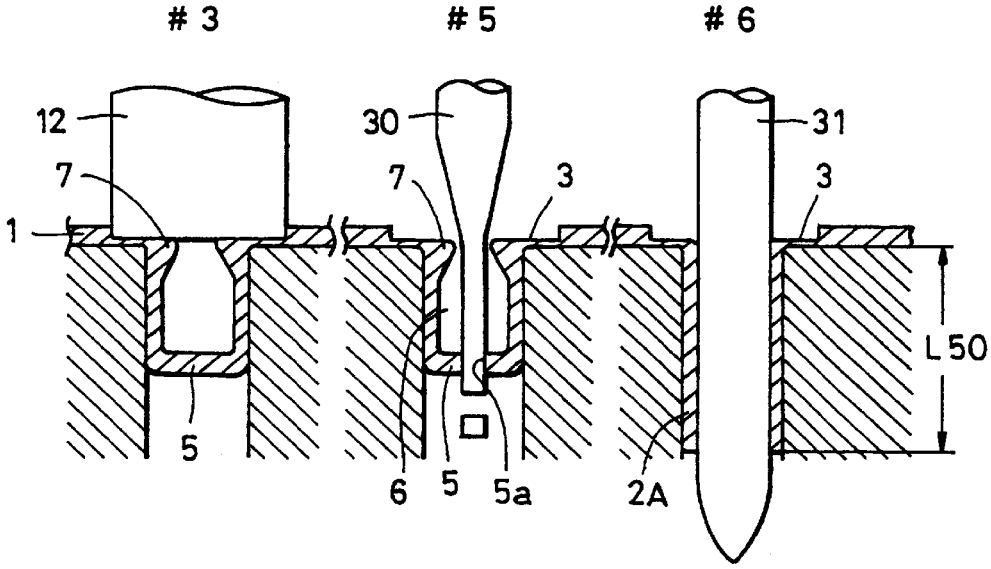
FIG. 5 is a process view showing steps of a method for forming a hollow pole of the present invention.

FIG. 5 is a view showing a process for forming a cylindrical hollow pole having a thruhole passing through from one side to the other side of the plate. In FIG. 5, a first press step #1, a second metal shifting step #2 and a flat press step #3 are the same as for FIG. 2 and are therefore omitted.

A thruhole 5*a* is then bored in the bottom of the projection 5 of the plate 1 that has passed through the flat press step #3 by a hole boring tool 30 in a hole boring step #5. The hole boring tool 30 is formed in a shape that tapers off towards its end. The hole boring tool 30 then comes into contact with the bottom of the projection 5 and bores the thruhole 5*a* by pressing.

After this, a burring step #6 is proceeded to. Here, a burring tool 31 formed in a substantially parabolic shape that tapers off towards the end of an external diameter that is the same as the diameter of the press tool 10 is inserted into the central part 6 and pressed. The thruhole 5*a* is then passed through and a cylindrical hollow pole 2A is formed. At this time, the metal of the bottom part of the projection 5 is extended by the burring tool 31 and a height L50 of the hollow pole 2A can therefore be made substantially larger than the height in the related art.

Figure 6:
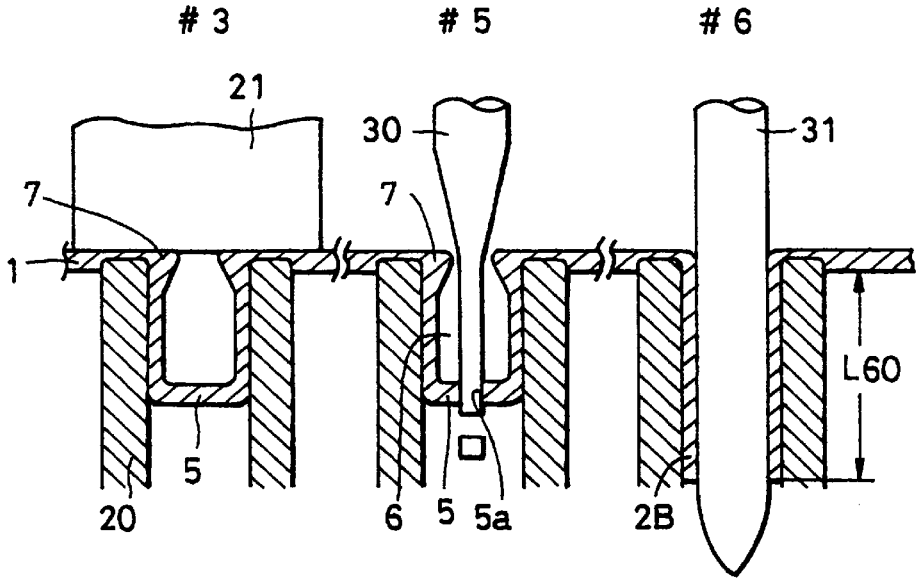
FIG. 6 is a process view showing steps of a further method for forming a hollow pole of the present invention.

FIG. 6 is a view showing a modified example of a process for forming a cylindrical hollow pole having a thruhole passing through the bottom surface of the plate. The forming process shown in FIG. 6 is based on the forming method shown in FIG. 3 and as the first press step #1, metal shifting step #2, and flat press step #3 are the same as for the forming method shown in FIG. #3, their description is omitted.

In the hole boring step #5 of FIG. 6, the hole boring tool 30 is brought into contact with the bottom part of the projection 5 of the plate 1 that has passed through the flat press step #3 and pressed down so that the thruhole 5*a* is bored in the bottom part of the projection 5.

After this, the burring step #6 is proceeded to and the burring tool 31 is inserted into the central part 6 and pressed so as to pass through the thruhole 5*a* and form a cylindrical hollow pole 2B. At this time, a height L60 of the hollow pole 2B can be made substantially higher as in the example in FIG. 5 because metal of the lower part of the projection 5 is extended by the burring tool 31.

Figure 7:
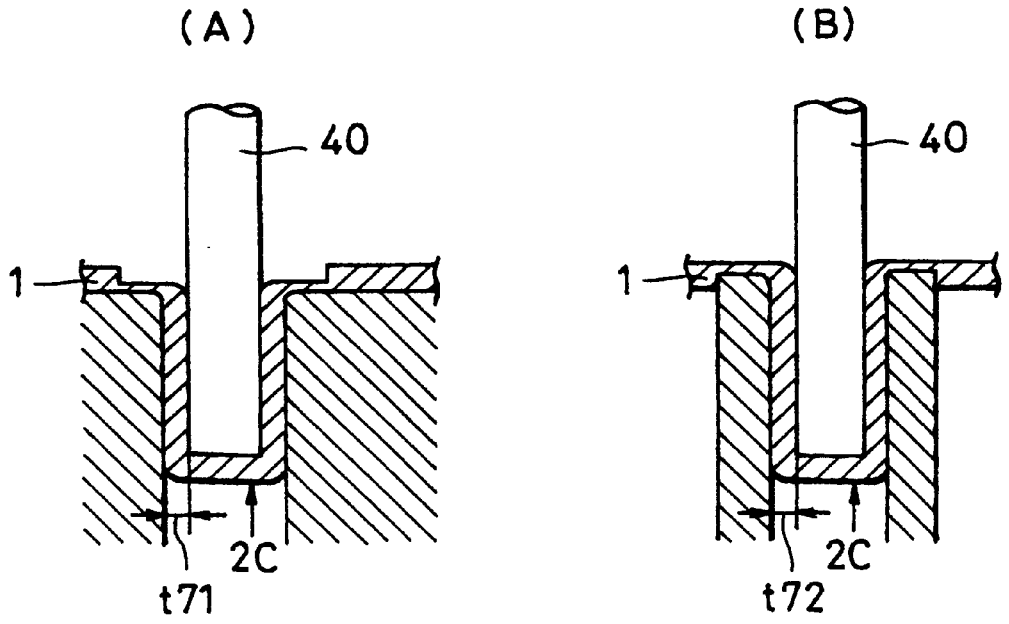
FIG. 7(A) and FIG. 7(B) are cross-sections showing a forming method for a case when the thickness of a hollow pole with a bottom is to be made thick.
Figure 8:
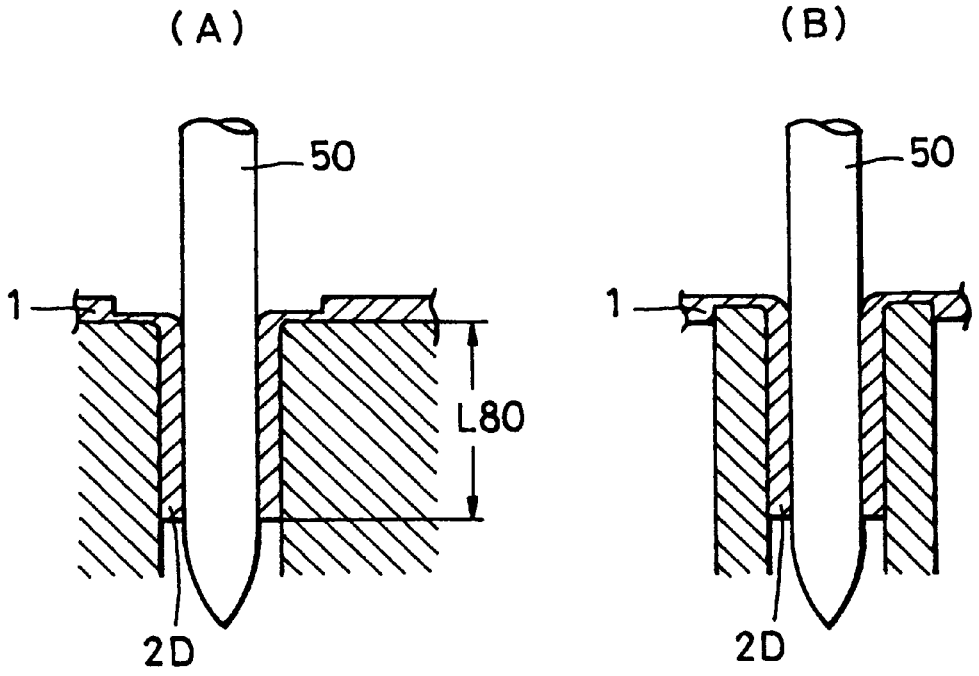
FIG. 8A and FIG. 8B are cross-sections showing a forming method for a case when the thickness of a hollow pole is to be made thick.
Figure 9:
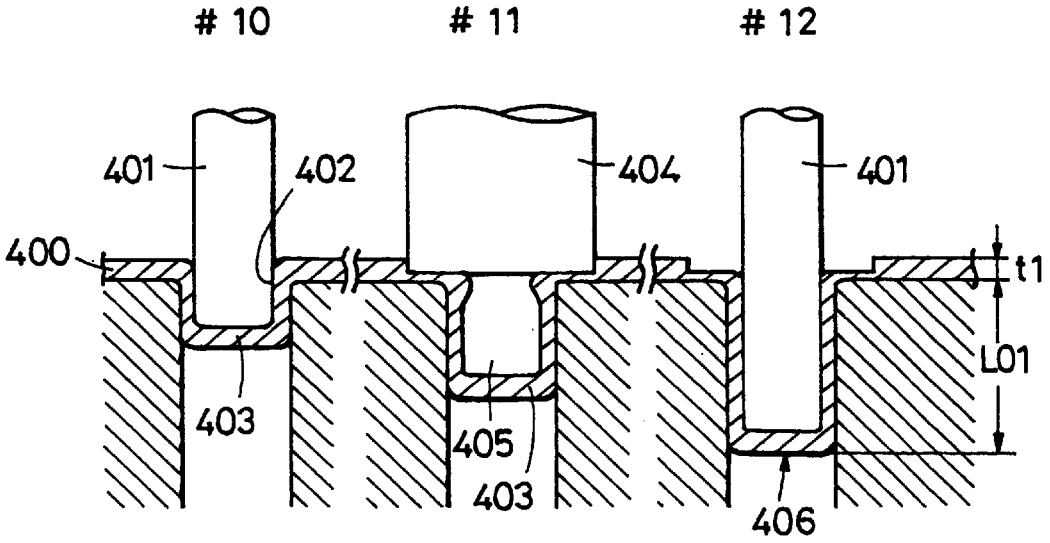
FIG. 9 PRIOR ART
FIG. 9 is a process view showing steps of a related method for forming a cylindrical projection at a plate.
Figure 10:
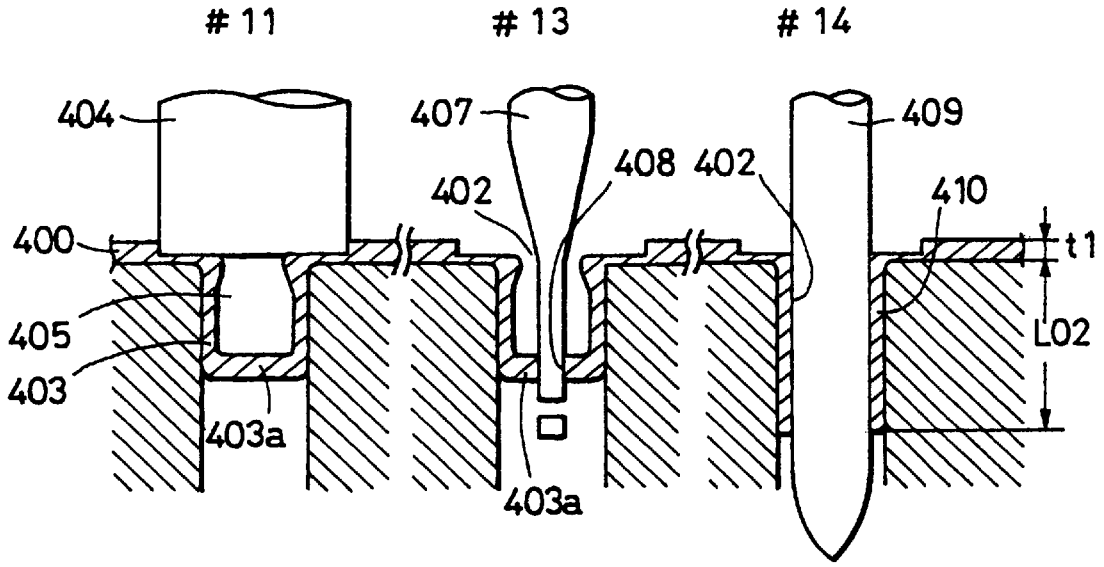
FIG. 10 PRIOR ART
FIG. 10 is a process view showing steps of a further related method for forming a cylindrical projection at a plate.

Methods for forming a projection to a substantially greater height are shown in each one of the examples described above. However, greater thickness for the same height as for the related art is also sought depending on the application. In such cases, forming can be achieved with the methods shown in FIG. 7 and FIG. 8.

FIG. 7(A) shows a method, based on the forming method shown in FIG. 2, where the thickness of the cylindrical projection having a bottom is increased. In FIG. 7(A), the first press step #1, metal shifting step #2, and flat press step #3 are the same as for the forming method shown in FIG. 2 and are therefore omitted. However, a point of distinction of this method from the method in FIG. 2 is that a press tool 40 used in the first press step #1 and second press step #4 is smaller in diameter. The internal diameter of the central part 6 of the projection 5 therefore becomes smaller when the press tool 40 of a smaller diameter is pushed from the side of the opening of the hole 4, with a hollow pole 2C being formed to a greater thickness as a result.

The height of the hollow pole 2C is substantially the same as the projection shown in the related example but a thickness t71 is substantially greater than that of the related forming method because metal at the periphery of the opening for the hole 4 is gathered by the tapered recess 11*a* of the tapered tool 11 and moved to the projection 5 so as to increase the metal at the projection 5.

FIG. 7(B) is a view showing a method, based on the forming method shown in FIG. 3, for thickening the cylindrical projection having a bottom. The point of distinction of this method shown in FIG. 7(B) is also that the press tool 40 used in the first press step #1, and the second press step #4 is smaller in diameter. A thickness t72 of the hollow pole 2C can therefore also be thickened in FIG. 7(B).

FIG. 8(A) and FIG. 8(B) show methods of making a cylindrical hollow pole having a thruhole passing from one side to the other side of a plate thicker. The method in FIG. 8(A) is based on the forming method shown in FIG. 5. The first press step #1, metal shifting step #2 and second press step #4 are therefore the same as for the forming method shown in FIG. 5 and are therefore omitted. Here, the point of distinction with FIG. 5 is that the external dimensions of the press tool and a burring tool 50 used in the first press step #1 and the burring step #6 have their diameters smaller to a greater extent than the press tool 10 described previously. The internal diameter of the central part therefore becomes smaller as a result of pushing the burring tool 50 from the side of the opening of the hole 4 and a thicker cylindrical hollow pole 2D is formed as a result.

In this example, a height L80 of the hollow pole 2D is substantially the same as for the projection shown in the related art. However, the projection 5 is formed to a much greater thickness than in the forming method of the related art because metal at the periphery of the opening of the hole 4 is gathered in the direction of the central part 6 by the tapered tool 11 and the tapered recess 11*a* so as to be moved to the projection 5 and increase the metal at the projection 5.

FIG. 8(B) is a forming method based on the forming method shown in FIG. 6. In FIG. 8(B), the point of distinction is that the burring tool 50 used in the first press step #1 and the burring step #6 is tapered. The details of this method are the same as described for FIG. 6 and are therefore omitted but the hollow pole 2D can also be made thicker as in FIG. 8(B).

In the above, a specific description is given based on the embodiments but the present invention is by no means limited to the above embodiments and modifications are possible that do not deviate from the essence of the invention as laid out in the patent claims. For example, rather than being cylindrical, the projection can also be a polygonal shape such as a substantially quadrilateral shape or a conical shape, or an ellipsoidal shape. The central part of the projection or the end portion etc. can also be made to be arbitrary shapes in response to various applications, such as a D-cut shape or a shape for forming a stopper etc. Further, in the above embodiments, examples of forming a single hollow pole are shown but it goes without saying that a plurality of hollow poles can also be formed in the plate.

Figure 11:
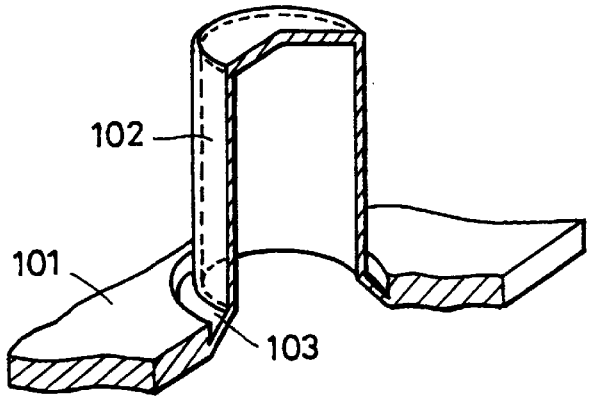
FIG. 11 is a sectional oblique cross-section showing a further example of a plate formed with a hollow pole of the present invention.

FIG. 11 is an oblique sectional cross-section showing a hollow pole manufactured using the method of the present invention. Here, a metal plate such as iron, copper, aluminum, or brass to which plastic deformation is applied is selected as a plate 101. A hollow pole 102 is then formed as a single hollow circular cylindrical body with a bottom protruding from the inside of the plate by plastically deforming a part of the plate 101. This hollow pole 102 is formed to a height that is three to five times the thickness of the plate 101 by a forming method described in detail later.

Further, an annular thin section 103 is formed at the peripheral edge of the hollow pole 102. This thin section 103 is thinner than the plate 101 and metal that was originally at the thin section 103 has been moved to the hollow pole 102 during plastic deformation in order to obtain a prescribed height for the protrusion axis 102. It is also possible to provide a plurality of hollow poles 102 next to each other at intervals greater than a prescribed internal diameter of the thin section 103. Further, it is preferable for the thin section 103 to be circular when the hollow pole 102 is circular but a polygon shape such as a substantially quadrangular shape or triangular shape or an ellipsoidal shape is also possible.

Figure 12:
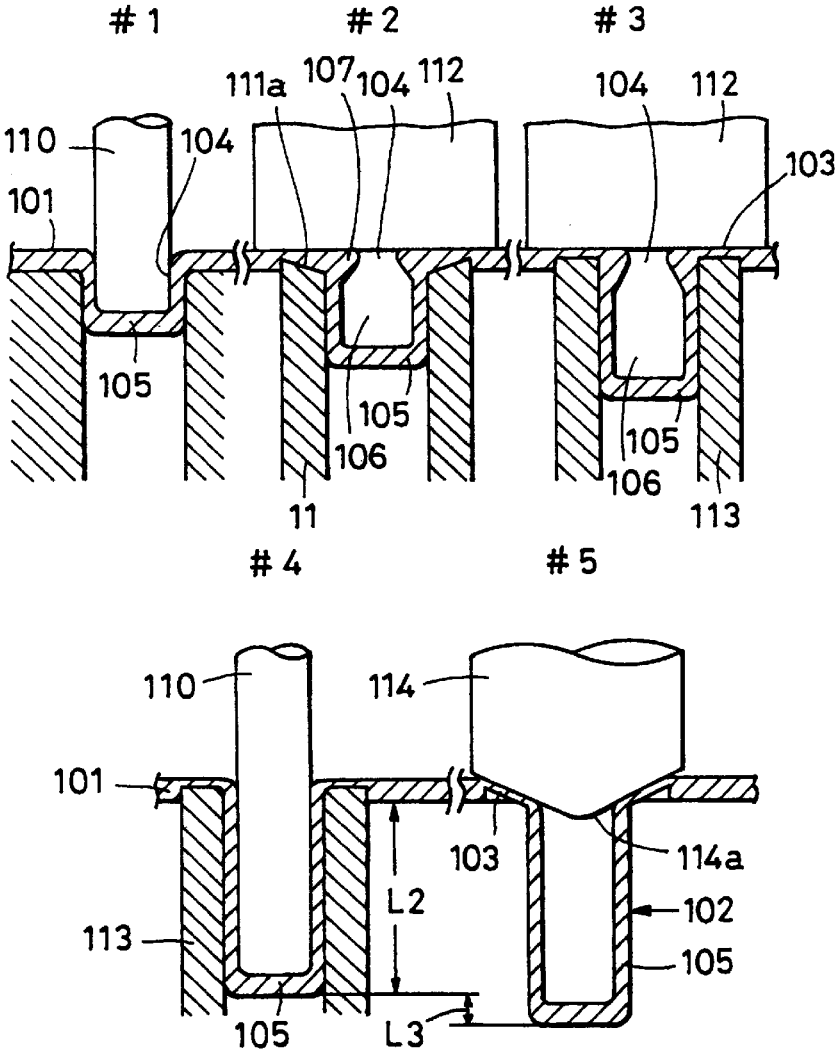
FIG. 12 is a process view showing steps of a method for forming a hollow pole at a plate of the present invention.

Next, a description is given of the method of the present invention for forming a hollow pole on a plate. FIG. 12 is a view showing the processes for forming the hollow pole 102 formed as a hollow circular cylinder with a bottom from the interior of a plate. First, in a first press step #1, one side of the plate 101 comprising a metal plate of iron or copper etc. is pressed by a press tool 110, with a hole 104 being formed on the one side of the plate 101 and a projection 105 being formed on the other side of the plate. The press tool 110 is formed as a cylindrical column with a flat end surface and the projection 105 is formed in a substantially cylindrical shape due to pressing by the press tool 110.

Next, the metal shifting step #2 is a process for gathering metal at the periphery of the opening of the hole 104 and moving this metal in the direction of the interior of the hole 104. A cylindrical tapered tool 111 used in step #2 is formed in the shape of a cylinder with an internal diameter that permits the insertion of the projection 105. The end surface of the tapered tool 111 is formed with a tapered recess 111*a* having a tapered surface 111*a* recessed in a substantially conical shape from the outer periphery of the end surface towards the center of the end surface.

An inner hole of the cylindrical tapered tool 111 is inserted into the projection 105 formed by the first press step #1. On the other side, a contact member 112 with a flat surface at one end is made to come into contact with one surface of the plate 1. The peripheral edge of the hole 4 is then pushed from the other side by the tapered recess 111*a* of the cylindrical tapered tool 111. The tapered recess 111*a* therefore gathers metal at the peripheral edge of the hole 104 in the direction of the central part 106 that offers no resistance, the metal is moved to the side of the opening of the central part 106 and metal 107 is formed. At this time, the projection 105 is made to project further.

The hollow pole 102 that has undergone the metal shifting step #2 then goes on to the next flat press step #3. In the flat press step #3, the periphery on the side of the other surface of the hole 104 is pressed with the contact member 112 in contact by a cylindrical flat press tool 113 with a flat front end and having an inner hole of an inner diameter that permits insertion of the projection 105. As a result, metal of the pressed portion is moved further in the direction of the central part 106 of the hole 104 and the projection 105 is further projected. At this time, the side of the other surface of the periphery of the projection 105 is annually depressed and the thin section 103 is formed.

Additional height is then added to the projection 105 by pressing the press tool 110 down again from the side of the opening with the cylindrical flat press tool 113 inserted in the second press step #4 so that a hollow pole 102 is formed.

A height L2 of the hollow pole 102 that has been subjected to the second press step #4 is substantially greater than that of the related forming method because in the metal shifting step #2, metal at the periphery of the opening of the hole 104 is gathered in the direction of the central part 106 by the tapered recess 111*a* of the cylindrical tapered tool 111 so as to be moved to the projection 105 and increase the metal of the projection 105. The plate 101 is then transferred to a further extrusion step #5 in order to further increase the height of the hollow pole 102.

In the extrusion step #5, the thin section 103 is further extruded in the direction of projection of the hollow pole 102 by an extrusion tool 14 with a front end surface 14*a* projecting in a substantially conical shape. As a result, a height L3 is added to the hollow pole 102 due to plastic deformation of the thin section 103 so that the hollow pole 102 is formed as the final shape. At this time, the extrusion height L3 due to the extrusion tool 14 is set to the same extent as the thickness of the plate 101. However, when the thin section 103 is not made to project from the surface of the plate 101 depending on the application, the height L3 of extrusion can be set in an appropriate manner such as a setting to less than the thickness of the plate 101.

Figure 13:
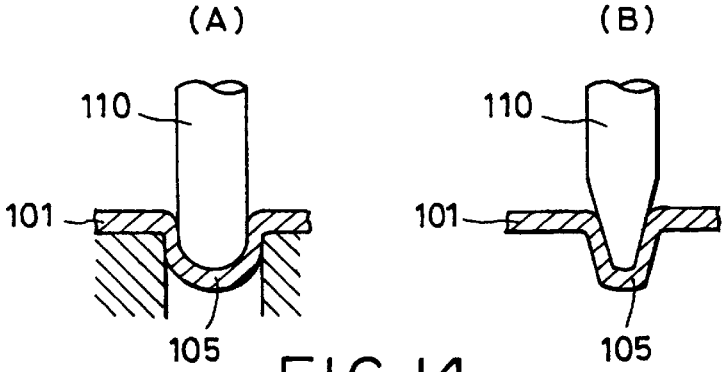
FIG. 13(A) and FIG. 13(B) are cross-sections showing modified examples of a first press tool of the present invention.

FIG. 13 shows a modified example of the press tool 110 used in the first press step #1, with FIG. 13(A) showing an example where the end is formed so as to be hemispherical and FIG. 13(B) showing an example where the end is at first flat and then tapered. In each of the aforementioned methods, a hollow pole 102 higher than that of the related art can also be formed using one of the these press tools.

Figure 14:
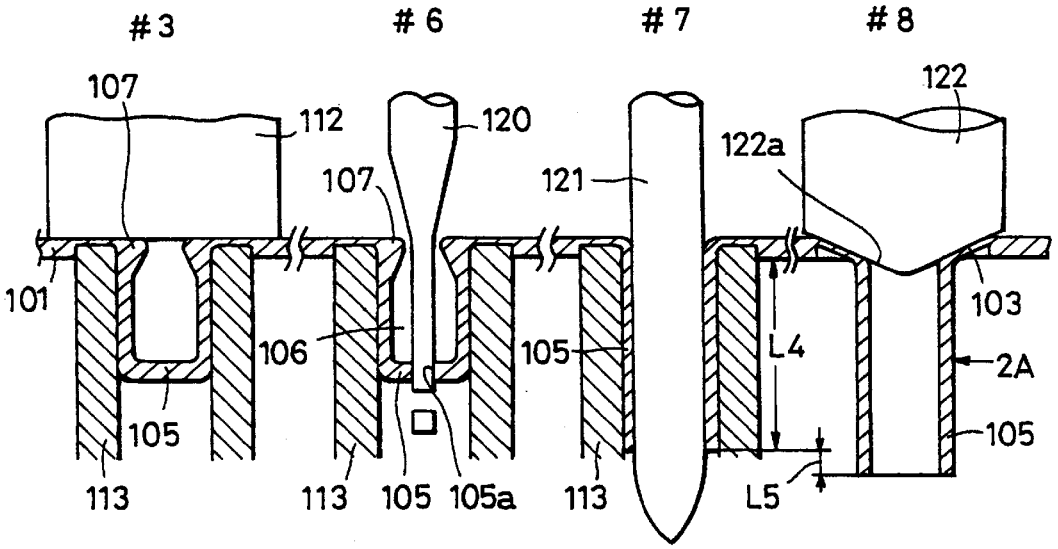
FIG. 14 is a process view showing steps of a method for forming a hollow pole of the present invention.

FIG. 14 is a view showing a process for forming a cylindrical hollow pole having a thruhole passing through from one side to the other side of the plate. In FIG. 14, a first press step #1, a second metal shifting step and a flat press step are the same as for FIG. 12 and are therefore omitted.

In a subsequent hole boring step #6, a small thruhole 105*a* is bored by a hole boring tool 20 formed tapered towards its front end pressing on the bottom part of the projection 105 of the plate 1 that has undergone the flat press step #3.

After this, a burring step #7 is proceeded to. Here, a burring tool 121, formed in a substantially parabolic shape and that tapers off towards the end and having an external diameter that is the same as the diameter of the press tool 110 shown in FIG. 12, is inserted into the central part 106 and pressed. The thruhole 105*a* is then passed through and a cylindrical hollow pole 102 is formed. At this time, the hollow pole 102 can be formed to a height L4 substantially greater than that of the related art because the metal of the bottom part of the projection 105 is extended by the burring tool 121 and the plate 101 has been subjected to the metal shifting step. The plate 101 is then transferred to a subsequent extrusion step #8 in order to make the height of the hollow pole 102 higher.

In the extrusion step #8, the thin section 103 is further extruded in the direction of projection of the hollow pole 102 by an extrusion tool 122 with a front end surface 122*a* formed in a substantially conical shape. As a result, a height L5 is added to the height of the hollow pole 102 due to plastic deformation of the thin section 103 so that the hollow pole 2A is formed as a result. At this time, the height L5 of the extrusion due to the extrusion tool 122 is set to the extent of the thickness of the plate 101 but can be set in an appropriate manner according to use.

Methods for forming a hollow pole to a substantially greater height are shown in each one of the examples described above. However, a projection of a greater thickness is also sought depending on the application. In such cases, forming can be achieved with the methods shown in FIG. 15 and FIG. 16.

Figure 15:
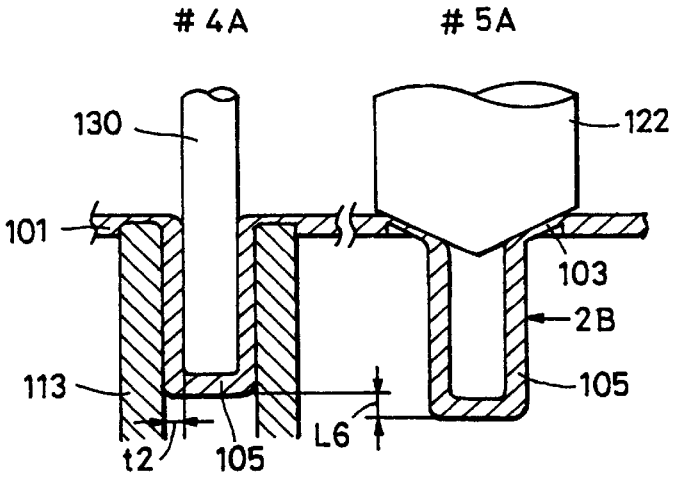
FIG. 15 is a cross-section showing a forming method of the present invention for the case where the thickness of a hollow pole having a bottom is made thick.

FIG. 15 shows a method, based on the forming method shown in FIG. 12, where the thickness of the cylindrical projection having a bottom is increased. In FIG. 15, the first press step #1, metal shifting step, and flat press step are the same as for the forming method itself shown in FIG. 12 and a description thereof is therefore omitted. However, a point of distinction of this method from the method in FIG. 12 is that a press tool 130 used in the first press step and second press step #4A is smaller in diameter. The internal diameter of the central part 106 of the projection 105 therefore becomes smaller when the press tool 130 of a tapered diameter is pushed from the side of the opening of the hole 104, and a thickness t2 can therefore be achieved. Thereafter, an extrusion step #5A is proceeded to, the thin section 103 is plastically deformed by extrusion by the extrusion tool 122 in the direction of projection of the projection 105 and a height L6 is added to the projection 105. As a result, a taller hollow pole 2B is formed.

The hollow pole 2B can therefore be formed to a much greater height than in the related example even when the hollow pole 2B is subjected to the metal shifting step #2 so as to be formed to a thickness t2 because the projection 105 is further extruded in the extrusion step 5A.

Figure 16:
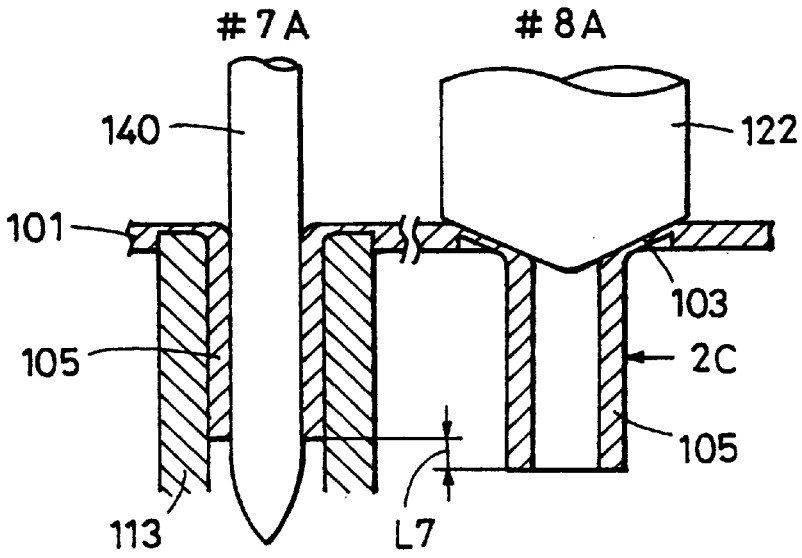
FIG. 16 is a cross-section showing a forming method of the present invention for the case where the thickness of a hollow pole is made thick.

FIG. 16 is a view showing a method where the thickness of a cylindrical hollow pole having a thruhole passing through the sheet from front to back is formed to be thick based on the forming method shown in FIG. 14. In the method shown in FIG. 16, a press tool for the first press step (not shown) and a burring tool 140 used in the burring step #7A are smaller in diameter. When burring is carried out using the burring tool 140 of a tapered diameter, the internal diameter of the projection 105 becomes small and a thickness t3 is then made thick.

After this, an extrusion step #8A is proceeded to, and a height L7 is added to the projection 105 as a result of plastic deformation of the thin section 103 by extrusion of the thin section 103 in the direction of projection of the projection 105 using the extrusion tool 122 so that the hollow pole 2C is formed. The hollow pole 2C can therefore be formed to a substantially greater height than that of the related example by this extrusion step even when the hollow pole 2C is made thick in the extrusion step.

Figure 17:
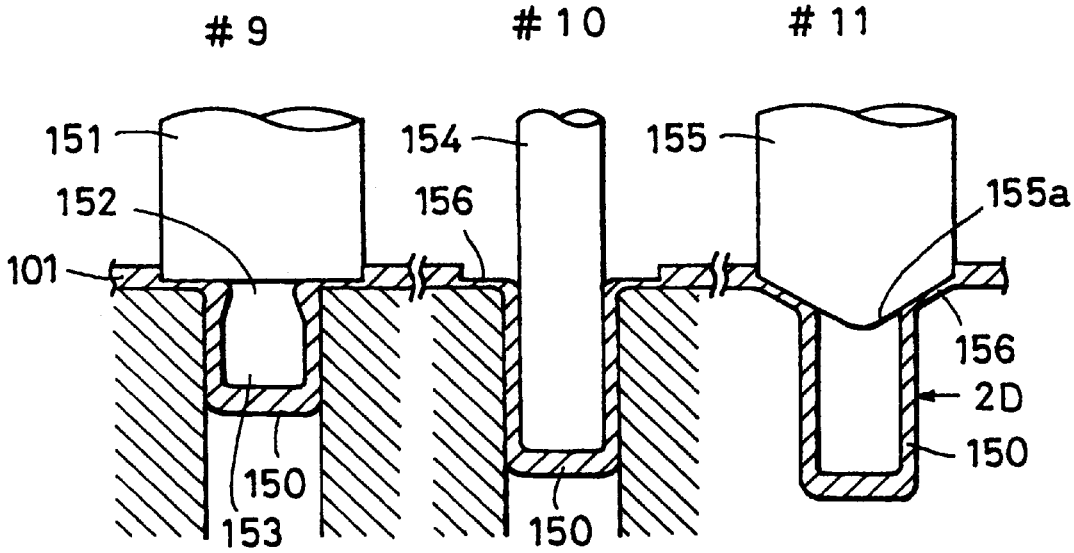
FIG. 17 is a process showing the steps of a further method for forming a hollow pole of the present invention.

FIG. 17 is a view showing an example of a further method for forming a hollow pole on a plate of the present invention. The first press step #1 is also the same as for the forming method shown in FIG. 12 in this example and a description thereof is therefore omitted. However, the point of distinction from the method of FIG. 12 is that the metal shifting step and the flat press step are carried out on a surface of the plate 101 on the opposite side from the projection 105.

Namely, in a flat press step #9, an end surface of a cylindrical flat press tool 151 of an external diameter greater than the external diameter of a projection 150 is brought into contact with the plate 1 that has undergone the first press step (not shown) from the side of an opening of a hole 152 and is then pressed. As a result, metal of the pressed portion is moved to a central part 53 of the hole 152 which provides no resistance so as to be moved to the projection 150 so as to project. A thin section 156 is then formed at the periphery of the opening of the hole 152 pressed by the flat press tool 151.

Next, in a second press step #10, the press tool 154 is again pressed against the plate 101 that has undergone the flat press step #9 from the side of the opening and further height is added to the projection 150. After this, the plate 101 is transferred to an extrusion step #11 and the thin section 156 is extruded in the direction of projection of the projection 150 by an extrusion tool 155. The thin section then undergoes plastic deformation and height is added to the projection 150. In this way, a hollow pole 2D is formed integrally with the plate 101.

The extrusion tool 155 is also formed with a substantially conical protruding front end surface 155*a* that is the same external diameter as the cylindrical flat press tool 51 or can be formed with a slightly smaller diameter. The thin section 156 is then subjected to plastic deformation by pressing the extrusion tool 155 down in a state concentric with the flat press tool 151 and the hollow pole 2D is made taller.

In the above, a specific description is given based on the embodiments but the present invention is by no means limited to the above embodiments and modifications are possible providing such modifications do not deviate from the essence of the invention as laid out in the patent claims. For example, in each of the above examples the front end surface of the flat press tool is substantially conical in shape but can also be hemispherical or have an external diameter smaller than the inner diameter of the thin section, with just the central side of the thin section than being subjected to plastic deformation. Further, in addition to being cylindrical, the projection can also be a polygon such as a quadrilateral or can be a column-shape. It also goes without saying that it is possible to form a plurality of projections in the plate.

The following is a description of a heat sink and a manufacturing method thereof formed with a plurality of heat dissipating units utilizing the aforementioned method of forming hollow poles.

Figure 18:
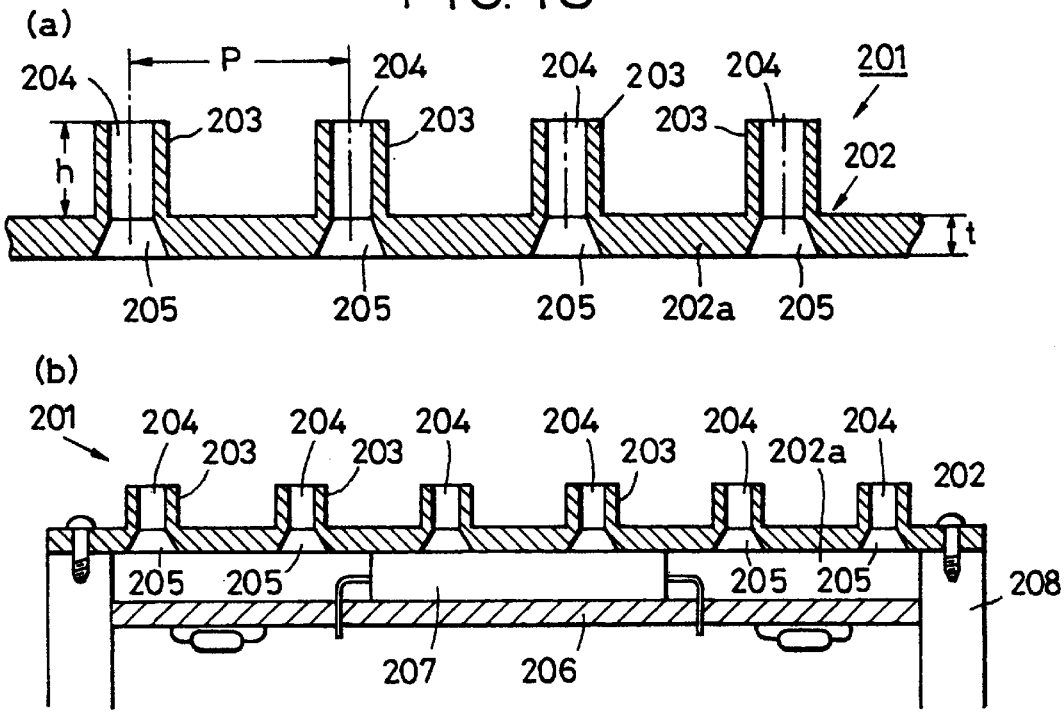
FIG. 18 is a view showing an embodiment of a heat sink of the present invention, with FIG. 18(*a*) being a cross-section of a heatsink unit and FIG. 18(*b*) being a cross-section showing a situation when electrical components are in contact with the heatsink.

FIG. 18 is a cross-section showing a heat sink unit formed by the forming method of the present invention, where FIG. 18(*a*) is an enlarged view showing a heat sink unit and FIG. 18(*b*) is a view showing the state when the heat sink comes into contact with electronic components generating heat.

As shown in FIG. 18(*a*), a plurality of heat dissipating fins 203 are formed as circular hollow poles in the heat sink 201 by subjecting a base 202*a* comprised of a metal plate 202 of a metal having a superior thermal conductivity such as aluminum to plastic deformation. The heat dissipating fins 203 are formed to a height of approximately 1 to 3 times a thickness t of the base 202*a* of the metal plate.

Thruholes 204 that penetrate through from one side to the other of the metal plate 202 are provided at the center of the heat dissipating fins 203.

Crater-shaped recesses 205 are formed at the peripheral edges of opening parts communicating with the thruholes 204 at the other surface of the metal plate 202 from which the cylindrical heat dissipating fins 203 are protruding. By forming the recesses 205, metal originally at the metal plate 202 is moved in the direction of the heat dissipating fins 203 by plastic deformation and a required prescribed height h can be obtained for the heat dissipating fins 203. The heat dissipating fins 203 are provided at prescribed intervals P so that the crater-shaped recesses 205 do not overlap. In addition to being circular, the heat dissipating fins 203 can also be polygonal shapes such as a quadrilateral or triangle.

Because the heat sink 201 has a plurality of heat dissipating fins 203 formed as hollow poles, surface area can be increased compared with related heatsinks having heat dissipating fins and the heat dissipating effects are therefore improved in proportion to the increase in the surface area. The surface area of the cylindrical heat dissipating fins 203 is the total surface area of the inner surfaces, outer surfaces and the upper end surfaces but in the case of the heat dissipating fins 203, at least the surface area of the inner surface of the thruholes 204 is increased. Further, heat dissipation due to cooling air being passed through is substantially facilitated by the providing of the thruholes 204.

As shown in FIG. 18(*b*), both ends of the above heat sink 201 are attached to a case 208 so that the lower surface of electronic components 207 such as a CPU etc. comes into contact with the heat sink so as to be substantially face to face. When the electrical components 207 then conduct electricity via a circuit board 206 on which a prescribed wiring pattern (not shown) is formed, heat occurring due to the operation of the electrical components 207 is transmitted to the heat sink 201 coming into contact with the electrical components 207. At this time, as a plurality of heat dissipating fins 203 are provided at the heat sink 201, in addition to the increased surface area, heat dissipation can also be carried out in an effective manner by passing cooling air using the thruholes 204.

Next, a description is given of a method of manufacturing the heat sink of the present invention.

Figure 19:
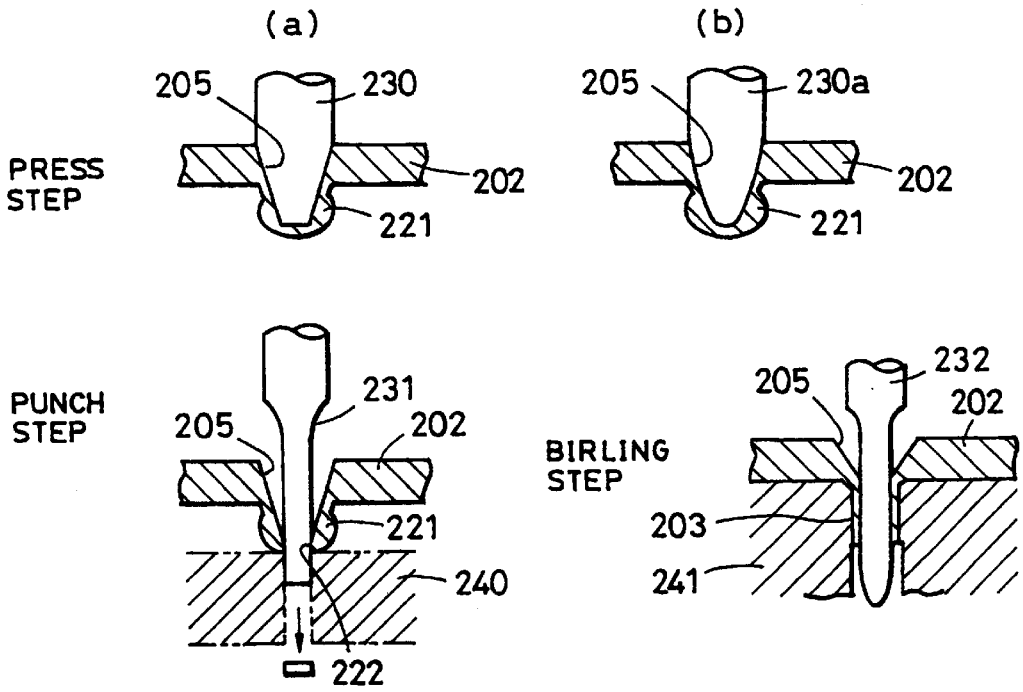
FIG. 19 is a view showing steps for manufacturing a heat dissipating fin at a heatsink of the present invention.

FIG. 19(*a*) to FIG. 19(*c*) show a manufacturing process of the heat-dissipating fins 203.

First, a press step is shown in FIG. 19(*a*). Here, a press tool 230 formed with a front end with a flat surface and of a small diameter and gradually tapering outwards from the front end is used to press the metal plate 202 formed of a metal having a superior thermal conductivity such as aluminum. The crater-shaped recess 205 is then formed to a depth exceeding the thickness of the metal plate 202 at one surface of the metal plate 202 and a projection 221 is extruded at the other surface of the metal plate 202.

When the crater-shaped recess 205 is formed at one side of the metal plate 202 in this press step, metal of the recess 205 is moved to the projection 221 formed at the other surface of the metal plate 202 and the metal of the projection 221 is therefore increased. The press tool in this press step can also be a press tool 230*a* with a front end formed in a substantially hemispherical shape. Further, it is not necessary to have the relatively large angled taper shown in FIG. 19 for the shape of the front end of the press tool and this angle can also be set to a smaller angle or an arbitrary angle, etc.

Next, in a punch step, the projection 221 of the metal plate 202 that has been subjected to the press step is mounted on a die 240 and a punch 231 having a rod-shaped section of a fine diameter is passed through from the open side of the crater-shaped recess 205 and the front end of the projection 221 is punched so as to form a thruhole 222 of a small diameter.

After this, the metal plate 202 that has passed through the punch step is mounted on a die 241 and a burring tool 232 having a rod section of a diameter greater than the rod section of the punch 231 is made to penetrate from the side of the opening of the crater-shaped recess 205 in a burring step. In this burring step, the diameter of the hole 222 is broadened and the heat dissipating fins 203 are formed. As a result, the height of the cylindrical heat dissipating fins 203 formed on the other surface of the metal plate 202 can be formed to a height of approximately one to three times the thickness of the plate. When the thickness of the metal plate 202 is taken to be 1 mm to 3 mm, the height of the heat dissipating fins is 1 mm to 9 mm. In the case of these thicknesses, heat dissipating fins 203 of outer diameters of 1 mm to 5 mm are preferred for the best heat dissipating results.

In each of these steps subjecting the metal plate 202 to plastic deformation, the production can be achieved at low costs because metal patterning of a complicated structure such as casting is not necessary. These steps can be carried out one after another or can be carried out individually. Usually, a large number of heat dissipating fins are formed at the same time using a large number of press tools 230, punches 231 and burring tools 232 but the heat dissipating fins can also be made one at a time or a plurality at a time.

By carrying out processing using the above three processes, heat dissipating fins 203 having a height of approximately one to three times the thickness of the plate can be formed at the metal plate 202. The surface area occurring at unit intervals including a plurality of heat dissipating fins 203 can therefore be increased for the heat sink 201 provided with the cylindrical heat dissipating fins 203 and heat dissipation effects can be increased substantially because the surface area has been increased by the thruholes 204 of the heat dissipating fins 203. Further, heat dissipation effects are increased because the surface area is substantially increased due to the crater-shaped recesses 205 being formed at the opening of the cylindrical head dissipating fin 203. In addition, it becomes easy for hot air to flow from the crater-shaped recesses 205 and to be led into the thruholes 204 of the heat dissipating fins 203 due to the effect of the shapes of the crater-shaped recesses 205. Convection effects are therefore increased as a result and the heat sink that dissipates heat more effectively is obtained. Typically, for integrated circuits such as CPUs etc. where cooling is particularly necessary, heat dissipation results that were about five times greater than those for a related heatsink were attained by forcibly cooling the heatsink 201 using a cooling fan or by passing cooling air within the thruholes 204 of the heat dissipating fins 203 using a cooling fan.

Figure 21:
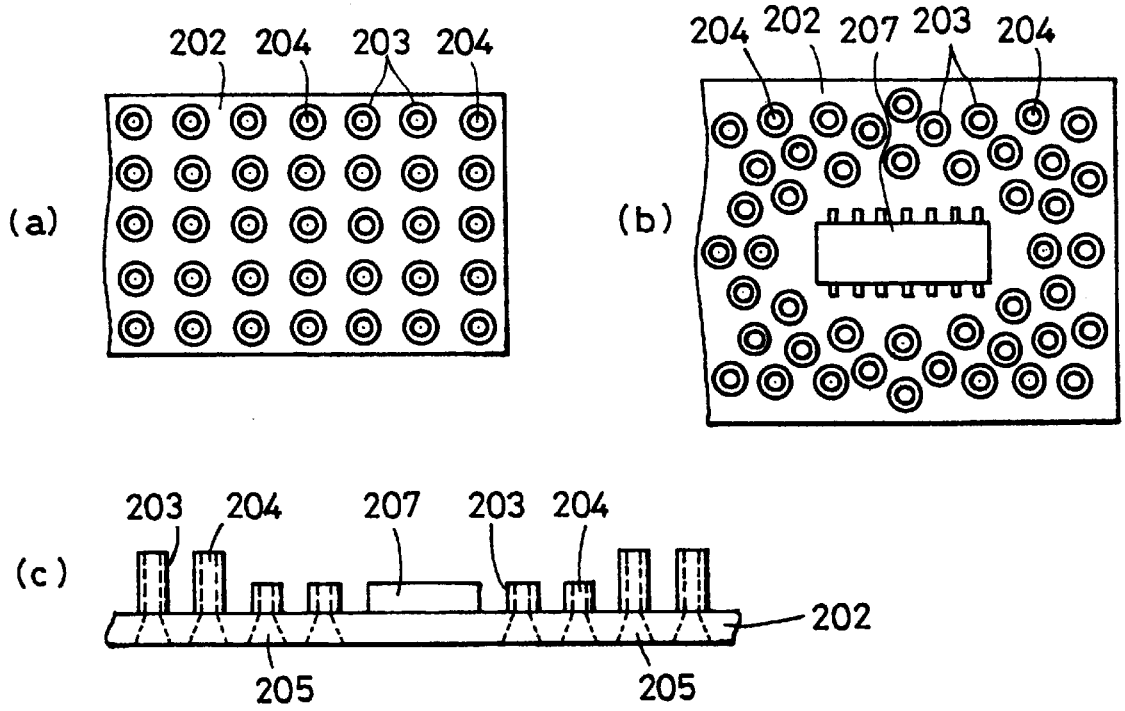
FIG. 21(*a*), FIG. 21(*b*) and FIG. 21(*c*) are views showing arrangements of heat dissipating fins of heatsinks of the present invention.
Figure 22:
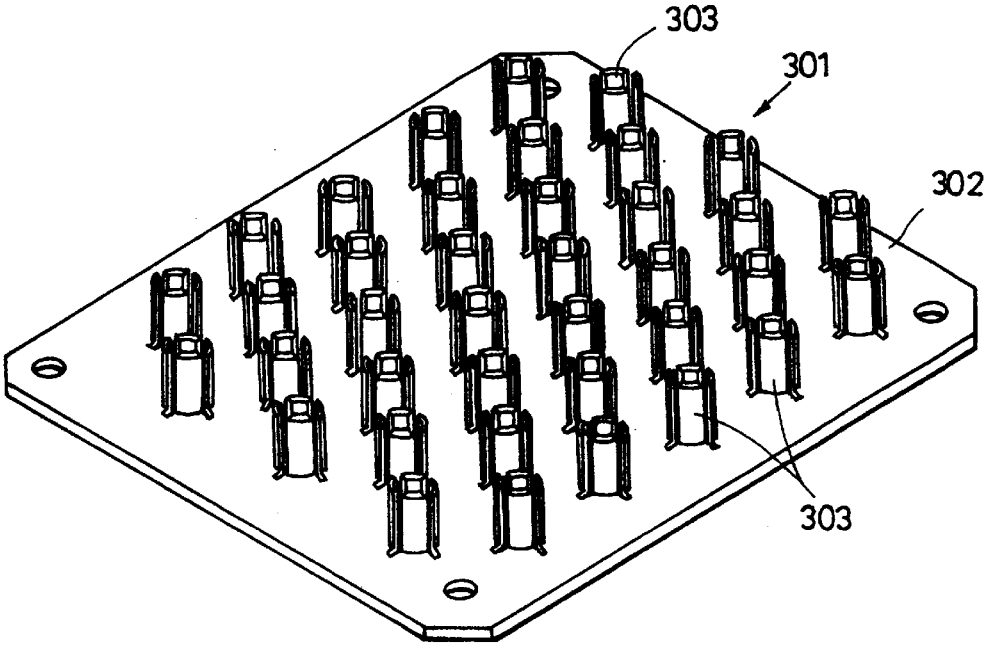
FIG. 22 is a perspective view showing a first embodiment of a heatsink of the present invention.
Figure 23:
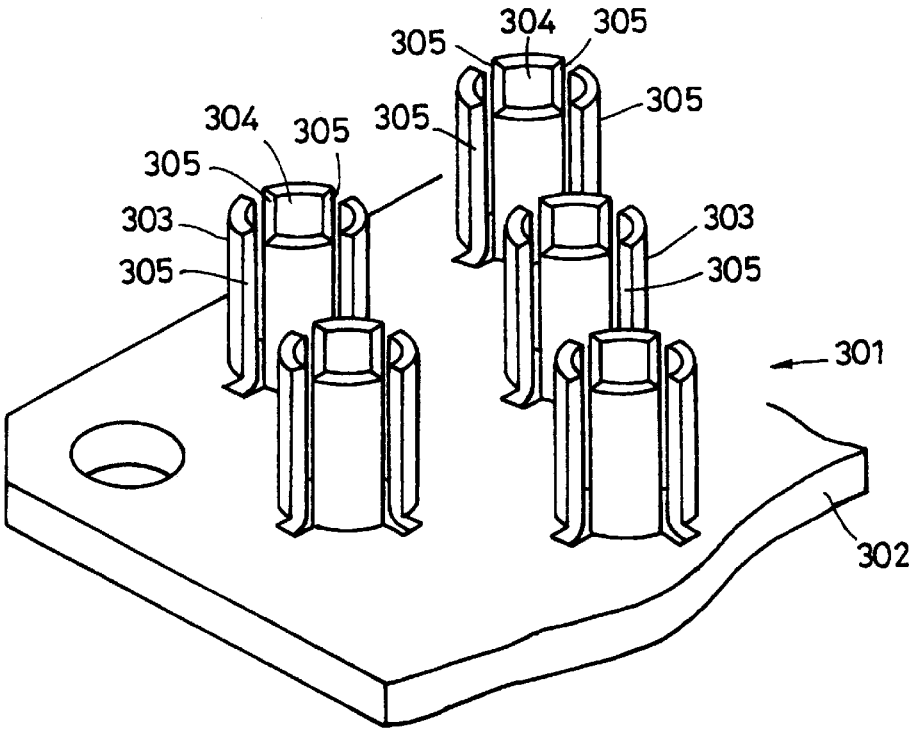
FIG. 23 is an oblique view with essential parts enlarged showing the heat dissipating fins of the heatsink of FIG. 18.
Figure 24:
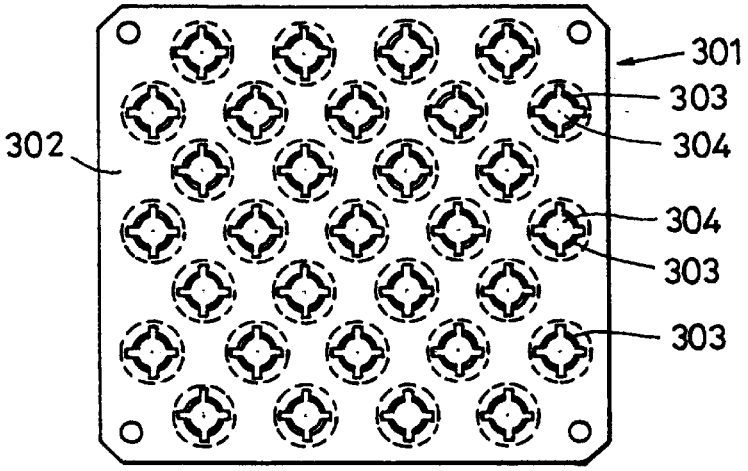
FIG. 24 is a plan view of the heatsink of FIG. 18.
Figure 25:
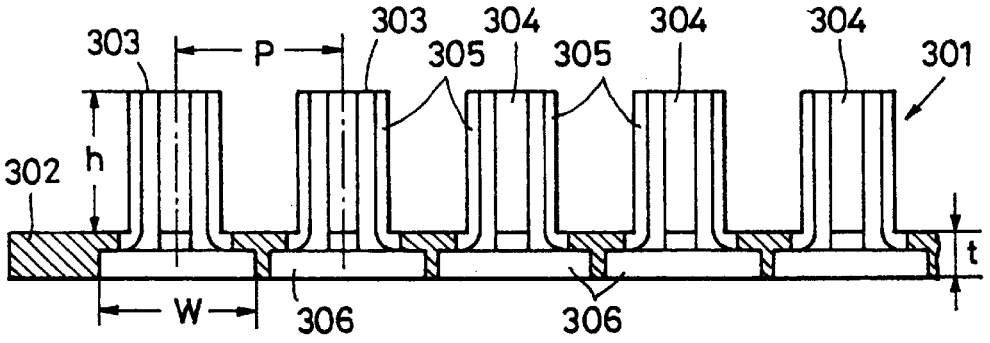
FIG. 25 is a cross-section of the heatsink of FIG. 18.

FIG. 21(*a*) and FIG. 21(*b*) are views showing examples of arranging heat dissipating fins 203 on the metal plate 202, where FIG. 21(*a*) shows a large number of heat dissipating fins 203 formed so as to be lined up in rows at the metal plate 202. FIG. 21(*b*) shows an example where a space is provided for mounting the electronic component 207 at the center of the metal plate 202 and a large number of heat dissipating fins 203 are formed randomly about the periphery of the electronic component 207. When the electronic component 207 is then arranged in this manner, various patterns for arrangement are possible for forming the heat dissipating fins 203 such as forming the plurality of heat dissipating fins 203 in a plurality of concentric circle shapes about the periphery of the electronic component 207 or forming the plurality of heat dissipating fins 203 gathered about the side of the heat generating portion of the electronic component 207. Alternatively, the electronic component 207 can be provided at a portion where heat dissipating fins 203 are not provided from the relationship between other neighboring structural components and the space.

Figure 20:
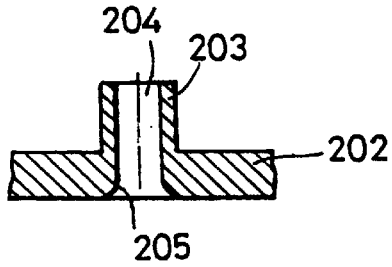
FIG. 20 is a cross-section showing a further example of a heat dissipating fin of a heatsink of the present invention.

In the above, a specific description is given of the present invention based on the embodiments but the present invention is by no means limited in this respect and various modifications that do not deviate from the spirit of the invention as stated in the patent claims are possible. For example, when the height of the plurality of heat dissipating fins 203 formed at the metal plate 220 is low, the punch step and the burring step can be carried out by the same implement. Further, the crater-shaped openings formed at the heat dissipating fins 203 can also be formed in the shape of an arc rather than as a straight tapered hole. Moreover, as shown in FIG. 20, the crater-shaped recess can be formed to a depth of less than half of the thickness of the metal plate 202 and, as shown in FIG. 21(*c*), it is also possible to have the heights of the heat dissipating fins 203 different depending on the portion at which the heat dissipating fins 203 are formed.

The following is a description with reference to FIG. 22 to FIG. 25 of a further method for forming a heat sink of the present invention.

In a heat sink 301 shown in FIG. 22 to FIG. 25, a large number of hollow cylindrical projections 303 as heat dissipating fins are integrally formed by taking a base 302 comprised of a metal having a superior thermal conductance such as aluminum or copper and subjecting parts of the base 302 to plastic deformation. Thruholes 304 are then provided at the axial centers of hollow cylindrical projections 303 as the heat dissipating fins, with the thruholes 304 penetrating from the bases 302 to the front ends of the projections 303. Four slits 305 are then formed at equal spacings extending from the bases 302 to the front ends along the axial direction at the hollow cylindrical projections 303. These hollow cylindrical projections 303 are then formed to a height greater than a thickness t of the base 302 of the metal plate and preferably to a height h two to five times greater than the height h by a forming method to be described in detail hereafter.

Further, thin sections 306 having a prescribed internal diameter w are formed at the peripheral edges at corresponding positions on the reverse side of the base 302 which is formed with the cylindrical projections 303. These thin sections 306 are thinner than the thickness t of the base 302, with metal that was originally at these thin sections 306 being moved to the projections 303 during plastic deformation in order to make the projections 303 of the prescribed height h. Each of the cylindrical projections 303 are provided next to each other at intervals p of greater than a prescribed internal diameter w of the thin sections 306. The thin sections 306 are preferably made circular when the projections 303 are cylindrical but do not have to be circular, and can also be a polygon such as a quadrilateral or triangle, etc.

With the heat sink 301 constructed in this manner, surface area is increased compared with the related heatsink having heat dissipating fins because the large number of projections 303 are formed in the shape of cylinders and heat dissipating effects are therefore improved in proportion to the increase in the surface area. The surface area of the cylindrical heat dissipating fins 203 is the total surface area of the inner surfaces, outer surfaces and the upper end surfaces but in the case of the cylindrical heat dissipating fins 303, at least the surface area of the inner surface of the thruholes 304 is increased. Further, heat dissipation due to cooling air flowing in a vertical direction from the base 302 through the thruholes is substantially facilitated by the providing of the thruholes 304.

Figure 26:
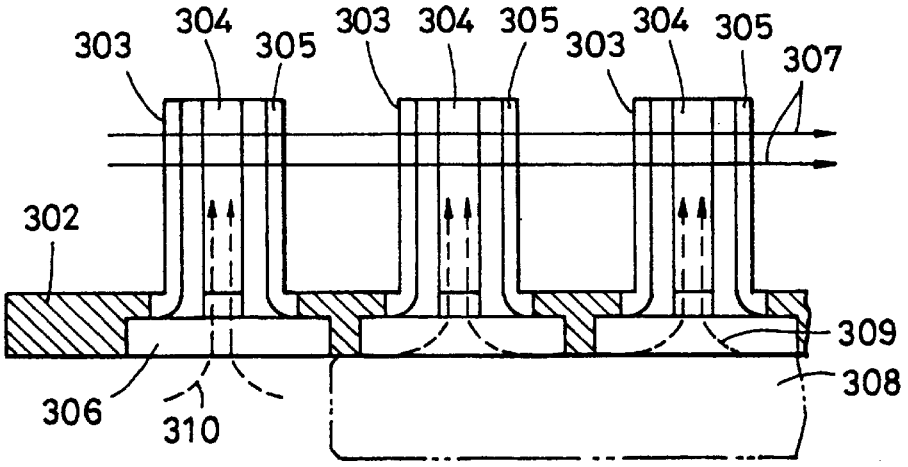
FIG. 26 is a view illustrating the operation of the heatsink shown in FIG. 18.

Further, as shown in FIG. 26, when cooling air 307 shown by solid lines passes through the slits 305, the thruholes 304 are at negative pressure because of the slits 305 formed so as to extend along the axial direction of a trunk portions of the projections 303 from the base 302 to the front ends thereof. Heated air 309 generated from an accompanying element 308 that generates heat and is lined up so as to face the reverse surface side of the heatsink 301 and air 310 heated at the periphery of the element 308 is therefore drawn into the thruholes 304 from the reverse surface side of the base 302 and expelled together with the cooling air 307. The heat dissipating effect due to the thruholes 304 is therefore multiplied so as to bring about a dramatic increase in the heat dissipation effect. Heat that has accumulated at the base 302 is also cooled by the passing of the heated air 310 and the heat dissipation effect is therefore further improved. This is to say that an almost ideal heatsink can be made by forming slits 305 in the projections 303. It also goes without saying that heat transmitted to the heatsink 301 can be emitted as radiated heat from the surface of the heatsink 301 as with a typical related heatsink.

The following is a description of a method of forming a heatsink of the present invention.

Figure 27:
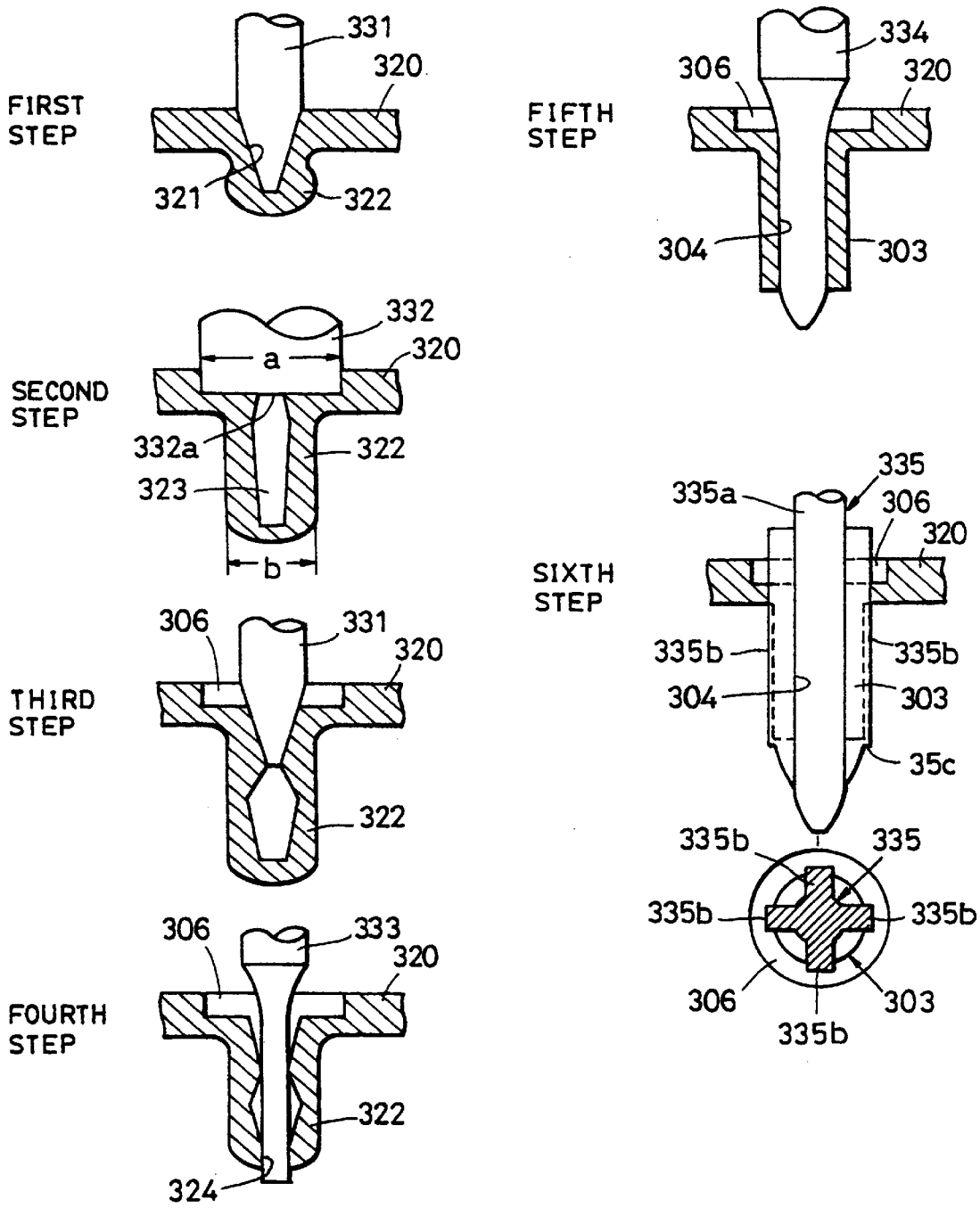
FIG. 27 is a manufacturing process view showing steps for forming a heatsink projection of the present invention.

FIG. 27 is a view showing steps for forming the hollow cylindrical projection 303 as heat dissipating fins, with the first to fifth steps being for a burring step for forming a hollow cylindrical projection penetrating the metal plate from one side to the other by plastic deformation of one surface of the metal plate. A sixth step is a slit forming step for forming a slit 305 in the outer periphery of the projection 303.

First, in a first step, a first tool 331 with a flat front end and tapering outwards from the front end is pushed down against a surface of a metal plate 320 of a metal such as aluminum having a superior thermal conductivity, so that a depression 321 is formed at one surface of the metal plate 320 and a projection 322 is formed at the other surface of the metal plate 320.

Next, in a second step, an end surface 332*a* of a columnar second tool 332 of a diameter a greater than the external diameter b of the projection 322 is brought into contact with the metal plate 320 that has undergone the first step from the side of the depression 321 and pressed so as to form the thin sections 306. Metal at the portion pressed by the second tool 332 is then moved to the projection 322 while being moved towards the a central section 323 that provides no resistance and the projection 322 is further elongated.

In a third step, the metal plate 320 subjected to the second step is again pushed from the side of the depression 321 by the first tool 331 and height is added to the projection 322. A projection 322 having a height of at least twice the thickness of the plate 320 is therefore formed by the steps undergone up to this point.

In a fourth step, a third tool 333 having a fine diameter stem portion is made to penetrate the metal plate 320 that has passed through the third step from the side of the depression 321 and a hole 324 is then made by punching out the end of the projection 322.

In a fifth step, the hole 324 is broadened by passing a fourth tool 334 having a stem portion of a wider diameter than the stem portion of the third tool 333 through the metal plate 320 that has passed through the fourth step from the side of the opening. As a result of carrying out this fifth step, a hollow cylindrical projection 303 is formed, and a thruhole 304 passing through from the thin section 306 to the end of the projection 303 is formed at the center of the axial direction of the projection 303 formed by the penetration of the fourth tool 334. Each of the first to fifth steps simply subject the metal plate 320 to plastic deformation. Metal patterning with complex structures such as in casting are therefore not required and production can be achieved at low cost. These steps can be carried out in a continuous sequence or can be carried out individually.

The cylindrical projection 303 formed in the above way can be formed to a height that is two to five times the thickness of the metal plate 320. After this, a plurality of slits 335 are formed at the outer periphery of the cylindrical portion of the projection 303 in a sixth step.

A fifth tool employed in a sixth step is a slit-forming punch 335. As shown in FIG. 27, four blade-shaped cutter blades 335b are formed so as to project at equal intervals and to extend along the axial direction at the outer periphery of a circular stem section 335*a* having an outer diameter that allows insertion into the thruhole 304 formed in the projection 303. The width of the cutter blades 335*b* is set in such a manner that the diameter of a circle formed by connecting the outer peripheries of the four cutter blades 335*b* is approximately equal to the outer diameter of the projection 303. The front ends of the cutter blades 335*b* are formed in such a manner that overall the blades taper outwards when going from the front ends toward the base but steps 335*c* are formed at the outer ends. The ends of the circular stem sections 335*a* also taper off so as to simplify penetration through the thruhole 304.

On the other hand, the projection 303 of the metal plate 320 is inserted into a hole formed in a metal-molded die (not shown). The fifth tool 335 is then inserted from the side of the depression 321 and the circular stem section 335*a* is made to pass through the thruhole 304. The four cutting blades 335*b* then cut away while being pushed in the axial direction of the cylinder of the projection 303. Four slits 305 are then formed in the cylindrical portion of the projection 303 when the cutter blades 335*b* pass the front end of the projection 303.

The number of cutting blades 335*b* formed to project from the slit-forming punch 335 is by no means limited to four, and an arbitrary number from two to eight can be provided depending on the number of slits 305 that are necessary. In the above embodiment, steps 335*c* are formed at the end portions of the cutting blades 335*b* but this is not essential. It is preferable to form the steps 335*c* in order to form slits 305 of a suitable appearance. The shape of the end of the fifth tool 335 can also be hemispherical rather than being substantially conical. In the second an third steps, the second step was taken to be necessary in order to increase the height of the projection 3 but at least the third process can be omitted when a low height for the projection 303 is appropriate. In this case, the front end of the second tool 332 shown in the second step can be changed to being substantially a conical stand shape.

When a projection 303 having slits 305 is formed by a process comprising a burring step of forming a hollow cylindrical projection that penetrates from one side to the other of the metal plate 320 by subjecting one surface of the metal plate 320 to plastic deformation and a slit forming process of pressing the slit-forming punch 335 formed with a plurality of cutting blades 335*b* into the thruhole 304 of the projection 303 so as to form slits 305 in the outer periphery of the projection 303, the projection 303 can easily be formed to the required height and the slits 305 can easily be formed at the outer periphery of the projection 303.

Figure 28:
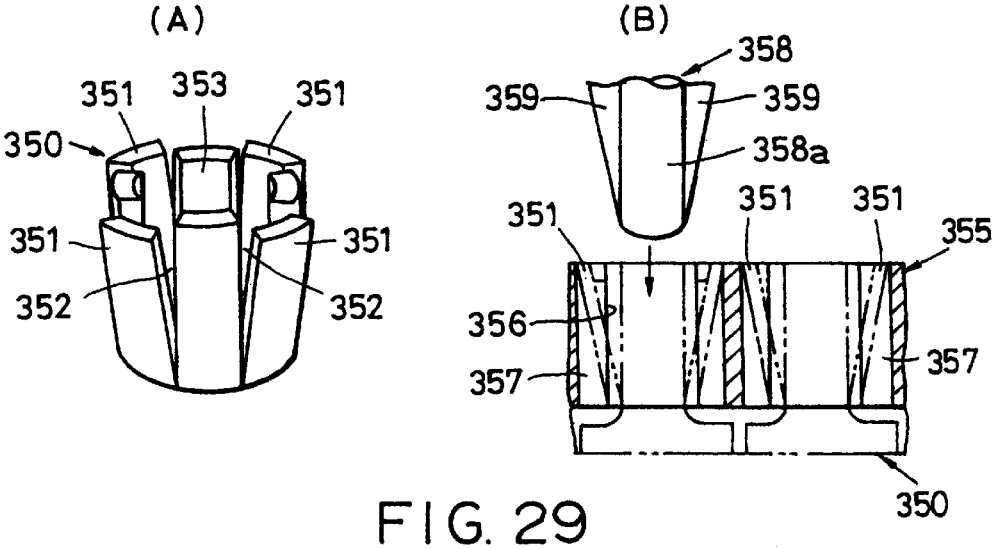
FIG. 28 is a view showing a second embodiment of the heatsink of the present invention, where

In the above embodiment, an example is shown of a heatsink 301 formed with a plurality of slits along the axial direction at the outer periphery of the projection 303 formed as a hollow pole but the slits can also be formed in other shapes. In the examples shown in FIG. 28 to FIG. 30, the body of a hollow cylindrical projection is divided up into partitions, with each partition being opened up outwards from the projection so as to form slits between the partitions.

In FIG. 28(A), the body of a hollow cylindrical projection 350 is partitioned into eight, with each one partition 351 opening up outwards from the base of the projection 350 towards the end side so that the projection 250 looks like the petals of a flower, with slits 352 therefore being formed between the partitions 351. As slits 352 are also formed at the front ends with this kind of projection 350, a state of negative pressure can also be made to occur within a thruhole 353 as in the previous embodiments by having cooling air pass through the slits 352. Hot air generated by an element that generates heat (not shown) that is surface-bonded to the rear surface of a heatsink 350 and surrounding air that is also heated is therefore drawn in and expelled together with the cooling air.

Next, a description is given of a method for forming the projection 350 shown in FIG. 28(A). The method up to the forming of the hollow cylindrical projection 350 is the same as the process in the first to fifth steps of FIG. 27 described for the previous embodiment and a description thereof is therefore omitted. The hollow cylindrical projection 350 formed in this manner is mounted at a slit-forming die 355. As shown in FIG. 28(B), the slit-forming die 355 is provided with an insertion hole 356 for insertion of the projection 350 and is formed with equally-spaced channels 357 at four places at the inner surface of the insertion hole 356. The radius of the inner surface of the channels 357 is formed so as to be larger than the radius of the insertion hole 356 with the thickness of the projection 350 added. A slit-forming punch 358 then comprises a stem 358*a* formed with an external diameter that is capable of insertion into a thruhole 353 of the projection 350 and four opening banks 359 formed so as to protrude out from the outer periphery of the stem 358*a* at positions corresponding to the channels 357. These opening banks 359 are tapered with their width gradually becoming greater from the front end side towards the rear.

After the projection 350 is inserted into the insertion hole 356 of the slit-forming die 355, the slit-forming punch 358 is forcibly inserted from the front end side of the projection 350. In this way, the outer periphery of the projection 350 positioned to correspond to the channels 357 is gradually sheared by the pressing of the opening banks 359 and, as shown by the two-dotted and dashed lines in FIG. 28(B), one partition 351 is pushed out into each one channel 357. As a result, as shown in FIG. 28(A), the body of the hollow cylindrical projection 350 is partitioned into eight, with slits 352 being formed between each one partition 351 and the neighboring remaining body of the projection 350.

In FIG. 29(A), the body of a hollow cylindrical projection 360 is partitioned into eight, with slits 362 being formed between these partitions 361 by bending each partition 361 into an approximate L-shape so as to open up towards the outside. As with the previous embodiment, as slits 362 are formed in the projection 360 if cooling air is passed through the slits 362, a state of negative pressure occurs within the thruhole 363 and the effect where hot air and surrounding heated air is drawn in and expelled can again be obtained.

Next, a description is given of a method for forming the projection 360, an example of which is shown in FIG. 29(A). The method for forming the hollow cylindrical projection 360 is the same process of the first to fifth steps of FIG. 27 described for the previous embodiment and a slit-forming metal die is substantially the same as the die 355 shown in FIG. 28(B), so the same numerals are given thereto and detailed descriptions thereof are omitted. On the other hand, a slit-forming punch 365 comprises a stem 366 formed with an external diameter that is capable of insertion into a thruhole 363 of a projection 360 and four opening banks 367 formed so as to protrude out from the outer periphery of the stem 365 at positions corresponding to the channels 356 of the die 355. However, the opening banks 367 are formed of fixed dimensions continuously from tapered parts 367*a* at the ends thereof.

After the projection 360 is inserted into the insertion hole 356 of the slit-forming die 355, the slit-forming punch 365 is inserted from the front end side of the projection 360. In this way, the outer periphery of the projection 360 positioned to correspond to the channels 357 is gradually sheared by the pressing of the opening banks 367 and, as shown by the two-dotted and dashed lines in FIG. 29(B), one partition 361 is pushed out into each one channel 357. As a result, as shown in FIG. 29(A), the body of the hollow cylindrical projection 360 is partitioned into eight, with each partition 361 being bent into an approximate L-shape so as to open out towards the outside of the projections 360. Slits 362 are therefore formed between the neighboring remaining parts of the body of the projection 360.

Figure 29:
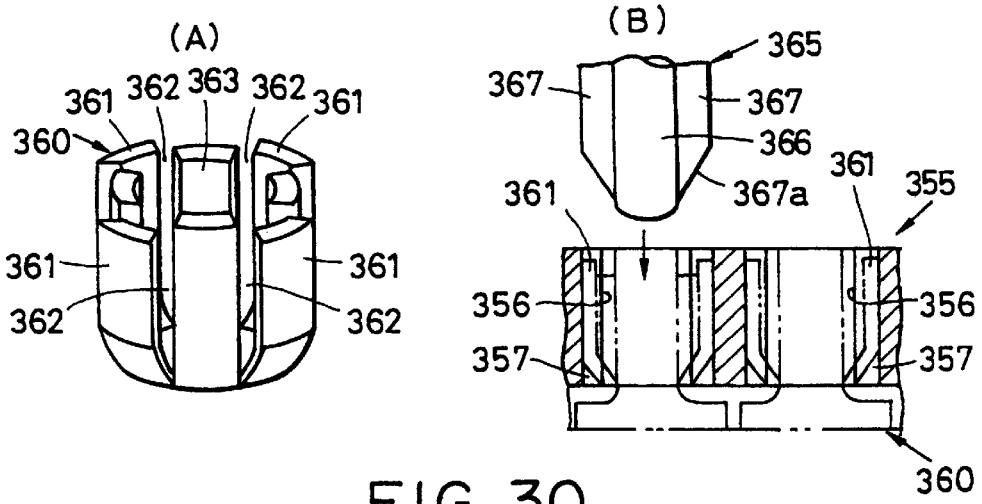
FIG. 29 is a view showing a third embodiment of the heatsink of the present invention, where
Figure 30:
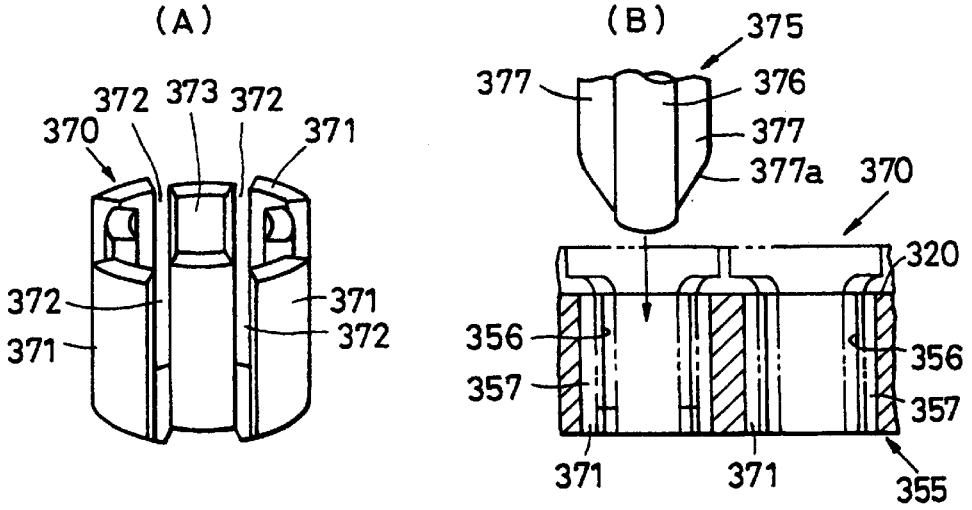
FIG. 30 is a view showing a second embodiment of the heatsink of the present invention, where

In FIG. 30(A), as in the example in FIG. 27 and FIG. 29, the body of a hollow cylindrical projection 370 is partitioned into eight, with the outer diameter of a locus formed by each one of the partitions 371 being greater than the dimensions of the outer circumference of the projection 370, so that slits 372 are formed between the partitions 371. As with the previous embodiment, as slits 372 are formed, if cooling air is passed through the slits 372, a state of negative pressure occurs within the thruhole 373 and the effect where hot air and surrounding heated air is drawn in and expelled can again be obtained.

Next, a description is given of a method for forming the projection 370, an example of which is shown in FIG. 30(A). The method for forming the hollow cylindrical projection 370 is the same as the process of the first to fifth steps of FIG. 27 described for the previous embodiment and a slit-forming metal die is substantially the same as the die 355 shown in FIG. 28(B), so the same numerals are given thereto and detailed descriptions thereof are omitted. On the other hand, a slit-forming punch 375 comprises a stem 376 formed with an external diameter that is capable of insertion into a thruhole 373 of a projection 370 and four opening banks 377 formed so as to protrude out from the outer periphery of the stem 376 in accordance with channels 357. However, the opening banks 377 are formed of fixed dimensions continuously from insertions 377*a* at the ends thereof.

After the projection 370 is inserted into the insertion hole 356 of the slit-forming die 355, the slit-forming punch 375 is inserted from the side of the metal plate 320 on the opposite side from the projection 370. As pushing of the slit-forming punch 375 then progresses, the inserts 377*a* are pushed in from the base of the projection 370, with the inserts 377*a* being positioned so as to correspond with channels 357, and the projection 370 is gradually sheared by the pressing of the opening banks 367 while, as shown by the two-dotted and dashed lines in FIG. 30(B), each one partition 371 is pushed out into each one channel 357. The body of the hollow cylindrical projection 370 is therefore partitioned into eight, with each one partition 371 standing up from the base and with a locus being formed by each one of the partitions having an outer circumference that is larger then the outer circumference of the projection 370. Slits 372 are therefore formed between the neighboring remaining parts of the body of the projection 370.

Figure 31:
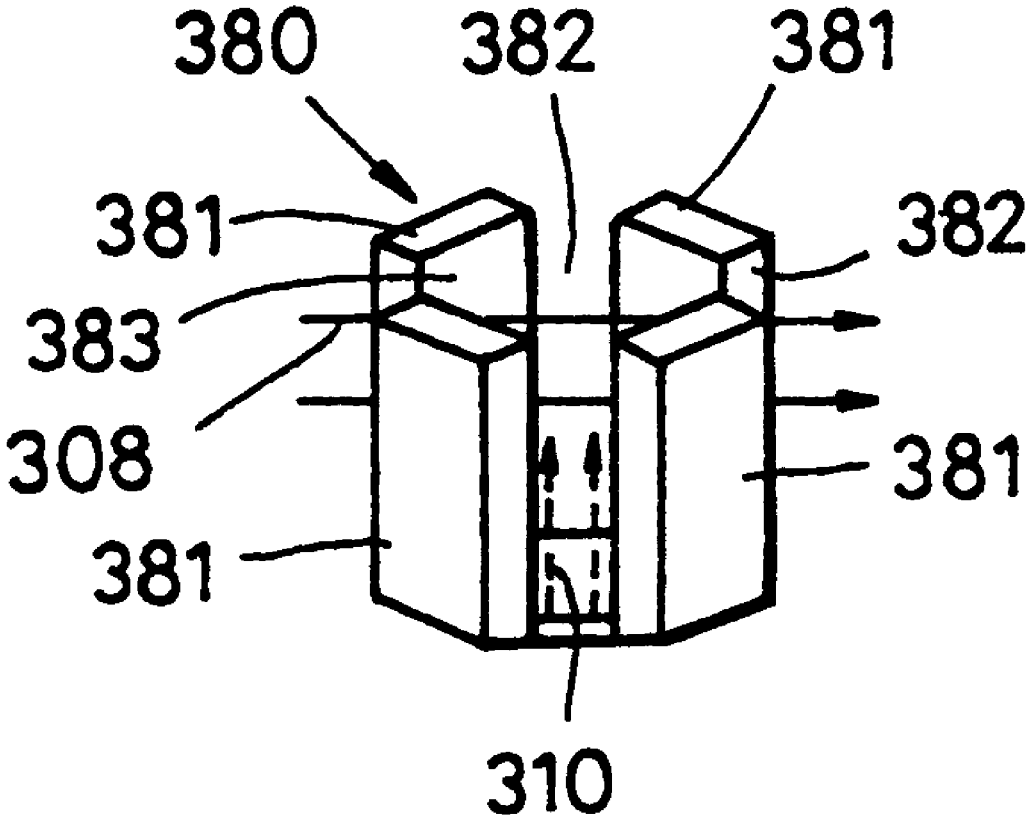
FIG. 31 is a perspective view of heat dissipating fins showing a heatsink of a fifth embodiment of the present invention.

In FIG. 31, as shown in the other embodiments, four flat partitions 381 are formed so as to stand up so as to give a projection 380 with mutually opposite partitions 381. Here, slits 382 are formed extending in the axial direction from the base of the projection 380 to the front end thereof. If cooling air 308 is therefore passed through the slits 382 in the manner shown by the solid lines in FIG. 31, a state of negative pressure occurs within a thruhole 383. Heated air 310 generated from an element lined up so as to face the rear surface of the heatsink 301 is therefore drawn in in the manner shown by the dotted lines at the rear surface of the base and is expelled together with the cooling air 308.

Various modifications are possible for each of the above embodiments of the present invention. For example, when manufacturing the cylindrical projection 303, the hole 324 is broadened by passing the fourth tool 334 having a large-diameter stem through from the opening side but it is also possible to form channels at the outer surface of the fourth tool 334 and push the fourth tool 334 into the hole 324 so that grooves are also formed at the inner surface of the hole 324 and the surface area of the inner surface is increased. In the further embodiments shown in FIG. 28 to FIG. 30, the partitions are made substantially equal but can also be made unequal, with, for example, the width of partitions projecting out from the projection being smaller.

As described above, in the method for forming a hollow poles projecting from a metal sheet of the present invention, there is provided a method of integrally forming a projection as a hollow pole in the sheet by plastic deformation, where a thin section is formed in an extrusion step so as to increase the height of the projection. It is therefore possible to make the projections substantially higher. Further, as the amount of metal shifted to the projection is increased by a metal shifting step, the height of the projection can be increased compared with projections formed by related projection-forming methods, or alternatively, the projection can easily be made thicker. The cost of adding these steps has a minimum influence on prices and manufacture is therefore cheap.

According to the method of forming a heatsink of the present invention, a plurality of hollow poles as cylindrical heat dissipating fins can be easily formed in a metal sheet with few steps and manufacturing costs can therefore be reduced. Further, by giving the cylindrical heat dissipating fins funnel-shaped openings, metal can be shifted to the cylindrical heat dissipating fins and high-quality heat-dissipating fins can therefore be formed. Moreover, heatsinks formed by this method have a large number of heat dissipating fins having heights in excess of the thickness of the metal plate and the overall surface area of the heatsink can therefore be increased. Air can also be made to flow through because the heat dissipating fins have thruholes that penetrate through from one side of the metal plate to the other and a heat dissipating effect can therefore be substantially improved. In particular, the heat dissipating effect can be improved several times over by passing cooling air through the thruholes of the heatsink when forcible cooling is carried out using the fins.

Still further, slits extending in the axial direction from the base to the front end are formed at the body of the hollow pole as the heat dissipating fins. A state of negative pressure therefore occurs when cooling air is passed through the slits so that heated air occurring at the reverse surface of the base is drawn in and expelled together with cooling air. The heat dissipating effect due to the thruholes of the hollow pole is multiplied and is therefore dramatically increased. According to the method of forming the heatsink of the present invention, hollow poles are formed at a surface of the metal sheet by a burring step and slits are formed at the outer periphery of the hollow poles using a slit-forming punch. Heat dissipating fins having slits can therefore be easily formed in few steps.

What is claimed is:

1. A method of forming a hollow pole projecting from a metal plate by plastic deformation comprising steps of:

(a) pressing the plate from one surface of the plate using a press tool so as to form a hole on the one surface and a projection on the other surface thereof;

(b) providing a tapered tool having a tapered recess at a front end surface, said tapered recess being substantially conical in shape and including an inclined surface gradually becoming deeper toward a center thereof;

(c) moving metal of the plate radially inward around said projection towards an interior of said hole so as to gather an increased amount of metal around a periphery of an opening of said hole using said tapered tool;

(d) pressing said periphery of said hole using a flat press tool which is greater than said projection in an external diameter so as to move the metal gathered by said tapered tool further towards the interior of said hole and to increase a height of said projection; and (e) inserting said press tool into said hole while pressing the interior of said hole so as to increase further the height of said projection and to form the hollow pole, wherein the hollow pole has a height greater than a thickness of the plate and is integral with the plate.

2. A method according to claim 1, further comprising:

pressing said tapered recess against the periphery of the opening of said hole from the one surface of the plate.

3. A method according to claim 1, wherein said tapered tool is cylindrical in shape having internal dimensions permitting said projection to be inserted and has a tapered section at a front end surface, said tapered section including an inclined surface gradually becoming deeper toward a center of said tapered tool, said tapered section being pressed against a proximate of a base end of said projection from the other surface of the plate, and wherein said flat press tool is cylindrical in shape having internal dimensions permitting said projection to be inserted and has a flat surface at a front end, said flat surface being pressed against said proximate of said base end of said projection from the other surface of the plate.

4. A method according to claim 1, further comprising steps of:

(e) boring a through-hole through a bottom part of the hollow pole using a boring tool; and (f) inserting a burring tool into the through-hole, said burring tool being tapered towards a front end thereof and including an external diameter same as said press tool at a position opposite said front end;

wherein the hollow pole is formed into cylindrical shape.

5. A method of forming a hollow pole projecting from a metal plate by plastic deformation comprising steps of:

(a) pressing the plate from one surface of the plate using a press tool so as to form a hole on the one surface and a projection on the other surface thereof;

(b) providing a tapered tool having a tapered recess at a front end surface, said tapered recess being substantially conical in shape and including an inclined surface gradually becoming deeper toward a center thereof;

(c) moving metal of the plate radially inward around said projection towards an interior of said hole so as to gather an increased amount of metal around a periphery of an opening of said hole using said tapered tool;

(d) pressing an outer periphery of said hole using a flat press tool which is greater than said projection in an external diameter so as to form a thin section, while moving metal corresponding to said thin section towards the interior of said hole and simultaneously causing said projection to project further;

(e) inserting said press tool into said hole while pressing the interior of said hole so as to increase the height of said projection and to form the hollow pole; and (f) deforming said thin section using an extrusion tool so as to extrude said hollow pole in a direction of projection of said projection and further increase the height thereof, wherein the hollow pole has a height greater than a thickness of the plate and is integral with the plate.

6. A method according to claim 5, further comprising a step of:

(e) moving metal of the plate around a base end of said projection towards the interior of said hole so as to collect the metal from a side of the other surface of the plate using a cylindrical tapered tool, said tapered tool having internal dimensions permitting said projection to be inserted and a front end surface, said front end surface including an inclined surface gradually becoming deeper toward a center of said tapered tool;

wherein said flat press tool is cylindrical in shape having internal dimensions permitting said projection to be inserted and has a flat surface at a front end, said flat surface being pressed against proximate of said base end of said projection from the other surface of the plate so as to form said thin section to be annular.

7. A method according to claim 5, further comprising steps of:

(f) boring a through-hole through a bottom part of the hollow pole using a boring tool; and (g) inserting a burring tool into the through-hole, said burring tool being tapered towards a front end thereof and including an external diameter same as said press tool at a position opposite said front end;

wherein the hollow pole is formed into cylindrical shape.

8. A method of manufacturing a heatsink, wherein a plurality of said cylindrical hollow poles formed by the method according to claim 7 are integrally formed on the plate either simultaneously or one after another, the plate being made of metal having superior thermal conductivity, and whereby said plurality of said cylindrical hollow poles form heat dissipating-fins of the heatsink.

9. A method of manufacturing a heatsink, wherein a plurality of said cylindrical hollow poles formed by the method according to claim 4 are integrally formed on the plate either simultaneously or one after another, the plate being made of metal having superior thermal conductivity, and whereby said plurality of said cylindrical hollow poles form heat dissipating-fins of the heatsink.

10. A method of manufacturing a heatsink, wherein a plurality of said cylindrical hollow poles formed by the method according to claim 1 are integrally formed on the plate either simultaneously or one after another, the plate being made of metal having superior thermal conductivity, and whereby said plurality of said cylindrical hollow poles form heat dissipating-fins of the heatsink.

11. A method of manufacturing a heatsink, wherein a plurality of said cylindrical hollow poles formed by the method according to claim 5 are integrally formed on the plate either simultaneously or one after another, the plate being made of metal having superior thermal conductivity, and whereby said plurality of said cylindrical hollow poles form heat dissipating-fins of the heatsink.

12. A method of manufacturing a heatsink according to claim 8 further comprising a step of:

forming a plurality of slits in a body of each of said cylindrical hollow poles while forcibly inserting a slit-forming punch having a plurality of cutter blades at an outer periphery thereof into said cylindrical hollow pole, said slits extending along the extending direction of said cylindrical hollow pole.

13. A method of manufacturing a heatsink according to claim 8, wherein parts of each body of said cylindrical hollow poles are punched out in an axial direction and removed so as to form said slits, when said slit-forming punch is forcibly inserted into said cylindrical hollow pole.

14. A method of manufacturing a heatsink according to claim 8, wherein the slit-forming punch has a plurality of opening banks projecting from the outer periphery thereof, said opening banks dividing each body of said cylindrical hollow poles into a plurality of partitions and opening up said partitions towards an outside so as to form said slits between neighboring partitions, when said slit-forming punch is forcibly inserted into said cylindrical hollow pole.

15. A method of manufacturing a heatsink according to claim 9, further comprising a step of:

forming a plurality of slits in a body of each of said cylindrical hollow poles while forcibly inserting a slit-forming punch having a plurality of cutter blades at an outer periphery thereof into said cylindrical hollow pole, said slits extending along the extending direction of said cylindrical hollow pole.

16. A method of manufacturing a heatsink according to claim 9, wherein parts of each body of said cylindrical hollow poles are punched out in an axial direction and removed so as to form said slits, when said slit-forming punch is forcibly inserted into said cylindrical hollow pole.

17. A method of manufacturing a heatsink according to claim 9, wherein the slit-forming punch has a plurality of opening banks projecting from the outer periphery thereof, said opening banks dividing each body of said cylindrical hollow poles into a plurality of partitions and opening up said partitions towards an outside so as to form said slits between neighboring partitions, when said slit-forming punch is forcibly inserted into said cylindrical hollow pole.

* * * * *